US005406355A

United States Patent [19]

Komuro et al.

[11] Patent Number: 5,406,355

[45] Date of Patent: Apr. 11, 1995

[54] PROCESS CARTRIDGE AND IMAGE FORMING APPARATUS

[75] Inventors: Akihiro Komuro; Takashi Maekawa; Makoto Matsuoka, all of Kawasaki, Japan

[73] Assignee: Fujitsu Limited, Kawasaki, Japan

[21] Appl. No.: 103,790

[22] Filed: Aug. 10, 1993

[30] Foreign Application Priority Data

Sep. 28, 1992 [JP] Japan ..... 4-257922

[51] Int. Cl.[6] ..... G03G 15/00

[52] U.S. Cl. ..... 355/210; 355/245

[58] Field of Search ..... 355/200, 210, 211, 245

[56] References Cited

U.S. PATENT DOCUMENTS

| | | | |
|---|---|---|---|
| 4,505,571 | 3/1985 | Kimura et al. | 355/309 |
| 4,924,267 | 5/1990 | Yoshikawa et al. | 355/245 X |
| 5,027,152 | 6/1991 | Oda et al. | 355/200 |
| 5,221,943 | 6/1993 | Hasegawa | 355/245 |
| 5,258,911 | 11/1993 | Miyake et al. | 355/210 |

*Primary Examiner*—A. T. Grimley
*Assistant Examiner*—Nestor R. Ramirez
*Attorney, Agent, or Firm*—Staas & Halsey

[57] ABSTRACT

There is disclosed a process cartridge exchangeably provided to an image forming apparatus provided with an endless light-sensitive carrier, a mechanism for charging the light-sensitive carrier, a cleaner for cleaning residual toner on the light-sensitive carrier, a cartridge frame installed with at least the light-sensitive carrier, the charging mechanism and the cleaner, the cartridge frame having a fulcrum hole, and wherein a developing unit is detachably provided to the cartridge frame for developing an electrostatic image on the light-sensitive carrier, the developing unit including a developing unit frame having a free fit hole and connection rod freely fitted into the fulcrum hole and as well freely fitted to the free fit hole of the developing unit frame for installing the developing unit to the cartridge frame such that the developing unit is rotatably movable with respect to the cartridge frame.

52 Claims, 14 Drawing Sheets

PROCESS CARTRIDGE AND IMAGE FORMING APPARATUS

BACKGROUND OF THE INVENTION

1. Field of the invention

The present invention relates to an exchangeable process cartridge used for forming an image and an image forming apparatus using the process cartridge, and particularly, to a process cartridge containing a light-sensitive carrier, a charging unit and a developing unit and an image forming apparatus using the process cartridge.

2. Description of the Related Art

Image forming apparatuses, such as a copying machine, a printer and a facsimile, employ a latent image forming type recording apparatus like an electrophotographing apparatus, due to a recent demand for image recording on normal sheets of paper. According to this image forming principle, after a photosensitive drum is precharged, the photosensitive drum is exposed to a light image to have an electrostatic latent image formed thereon. This electrostatic latent image is developed by a developing unit so that a toner image is formed on the photosensitive drum. This toner image is then transferred onto a sheet of paper to obtain the toner image on the sheet.

These image forming process units, such as the photosensitive drum etc, have a limited service life due to the functional deterioration of the photosensitive drum, filling up of toner collected in a cleaner, contamination of a charging unit and abrasion of a developing roller of the developing unit during the use of the apparatus. Therefore, it is necessary to exchange a process unit with a new one. In particular, in a case of compact image forming apparatus, the interval of the exchange is shorter as it is constituted in a smaller size.

On the other hand, it is troulbesome for users that they exchange individually each process unit installed separately. And it is further requiring to adjust a position of the process units each other. For this reason, it is effective to provide a means allowing the users to exchange an expired cartridge with a new cartridge by installing these unit in a single cartridge. According to this way, it is convenient for the users, as they can exchange a plurality of units by single handling and are not requested to make adjustment such as positioning of units. For the process cartridge described above, the ones which can be exchanged easily, being exchangeable of the expired unit alone, are preferable.

FIGS. 1A and 1B are explanatory diagrams of prior art. As the process cartridge described above, two types of process cartridge are known. One of which type installs every process unit in a single cartridge as shown in FIG. 1A, and the other type installs a part of process units in a single cartridge as shown in FIG. 1B.

The type shown in FIG. 1A is a process cartridge 150 provided with a photosensitive drum 151, a charging unit 152 for charging the photosensitive drum 151, a cleaner 153 for removing and collecting the residue toner on the photosensitive drum 151 and a developing unit 160 for developing an electrostatic latent image on the photosensitive drum 151. According to this process cartridge 150, time and labor for the exchanging can be reduced, as all of the process units except optical unit for exposing to a light image and transfer unit can be exchanged together by pulling out the cartridge. However, in a case of this process cartridge 150, if the service life of the photosensitive drum 151 alone expired, the developing unit 160 should be exchanged at the same time before its service life actually expire. If the service life of the developing unit 160 expired, the photosensitive drum 151 should be exchanged likewise at the same time before its service life actually expire. Therefore, in this constitution, it will be a waste of resources.

In the scope of this constitution, a contact type developing unit, which develops an image by contacting a developing roller with the photosensitive drum, is known as a developing unit. When the contact type developing unit is employed, it is required that the contact pressure of the developing roller with the photosensitive drum is a constant, for obtaining a stable developing operation. However, according to the constitution of prior art, there is a fear that a stable developing operation becomes difficult, as the pressure of contact fluctuates due to external factors.

On the other hand, FIG. 1B illustrates a process cartridge provided with a photosensitive drum 151, a charging unit 152 for charging the photosensitive drum 151 and a cleaner 153 for removing and collecting the residue toner on the photosensitive drum 151. It means that the developing unit 160 is separately provided from the process cartridge 154. This constitution is based on the idea that the exchange of both developing unit 160 and photosensitive drum 151 at the same time is uneconomical since the service life of the developing unit 160 can be extended by supplying toner or the like, thereby making the service life thereof longer than that of the photosensitive drum 151. In this constitution, it is possible to exchange any of the cartridge 154 alone, the developing unit 160 and both of the cartridge 154 and the developing unit 160.

However, it is necessary to pull out the cartridge 154 from the apparatus prior to the exchange of the developing unit 160, since the cartrige 154 is provided above the developing unit 160. And if both are exchanged, it is necessary to pull out the both respectively from the apparatus, then set them respectively to the apparatus. Therefore, time and labor are required for pulling out them from the apparatus and setting them to the apparatus. Furthermore, since the cartridge 154 and the developing unit 160 are separately provided in the apparatus, a positioning mechanism for the cartridge 154 and the developing unit 160 is required in the apparatus, thus the mechanism of whole apparatus is brought to a complication.

SUMMARY OF THE INVENTION

It is an object of the present invention to provide a process cartridge designed to facilitate exchange of process units for an apparatus and an image forming apparatus using the process cartridge.

It is another object of the present invention to provide a process cartridge wherein a cartridge and a developing unit can be exchanged separately and an image forming apparatus using the process cartridge.

It is a further object of the present invention to provide a process cartridge which is easy for setting position of units even if a cartridge and a developing unit are separately exchanged, allowing to give a stable image formation and an image forming apparatus using the process cartridge.

It is a still further object of the present invention to provide a process cartridge for performing a stable developing operation without having the influence from the external factors even if the contact type developing unit is provided in the cartridge and an image forming apparatus using the process cartridge.

To achieve the foregoing and other objects, one aspect of the process cartridge according to the present invention comprises an endless light-sensitive carrier, a charging means for charging the light-sensitive carrier, a cleaner for cleaning a residual toner on the light-sensitive carrier, a cartridge frame installed with at least the light-sensitive carrier, the charging means and the cleaner and a developing unit detachably provided to the cartridge flame, for developing an electrostatic latent image on the light-sensitive carrier.

Further, one aspect of the image forming apparatus according to the present invention comprises an endless light-sensitive carrier, a charging means for charging the light-sensitive carrier, an optical means for exposing the charged light-sensitive carrier to a light image, a cleaner for cleaning a residual toner on the light-sensitive carrier, a process cartridge installed with at least the light-sensitive carrier, the charging means and the cleaner, a developing unit detachably provided to the process cartridge, for developing an electrostatic latent image on the light-sensitive carrier and a transfer means for transferring a toner image on the light-sensitive carrier onto a sheet.

With the above structure, as the developing unit is detachably provided to the cartridge frame where the light-sensitive carrier or the like are installed with, the developing unit can be pulled out along with pulling out of the process cartridge from the apparatus. Accordingly, by pulling out the process cartridge from the apparatus, the developing unit alone can be detached from the process cartridge, thereby allowing the exchange of the developing unit alone. Moreover, the exchange of the whole process cartridge containing the developing unit is possible by pulling out the cartridge by single handling. It is further possible to exchange any of the developing unit alone, the cartridge containing the developing unit and the cartridge excluding the developing unit, by once installation of the process cartridge provided with the exchanged developing unit or the exchanged process cartridge to the apparatus. In addition, as the developing unit is incorporated to the cartridge, a positioning of the units is not required, so that the mechanism of the apparatus can be simplified as the positioning mechanism is not required in the apparatus.

Another aspect of the process cartridge according to the present invention comprises an endless light-sensitive carrier, a charging means for charging the light-sensitive carrier, a cleaner for cleaning a residual toner on the light-sensitive carrier, a cartridge frame installed with at least the light-sensitive carrier, the charging means and the cleaner, a developing unit rotatably provided to the process cartridge around a rotary fulcrum, for developing an electrostatic latent image on the light-sensitive carrier by contacting a developing roller for supplying internal developer with the light-sensitive carrier, wherein the rotary fulcrum is located in the position in the direction of a tangent line to both of the light-sensitive carrier and the developing roller at a contact position of the light-sensitive carrier and the developing roller.

Further, another aspect of the image forming apparatus according to the present invention comprises an endless light-sensitive carrier, a charging means for charging the light-sensitive carrier, an optical means for exposing the charged light-sensitive carrier to a light image, a cleaner for cleaning a residual toner on the light-sensitive carrier, a process cartridge installed with at least the light-sensitive carrier, the charging means and the cleaner, a developing unit rotatably provided to the process cartridge around a rotary fulcrum, for developing an electrostatic latent image on the light-sensitive carrier by contacting a developing roller for supplying internal developer with the light-sensitive carrier and a transfer means for transferring a toner image on the light-sensitive carrier onto a sheet, wherein the rotary fulcrum is located in the position in the direction of a tangent line to both of the light-sensitive carrier and the developing roller at a contact position of the light-sensitive carrier and the developing roller.

With the above structure, since the rotary fulcrum of the contact type developing unit is located in the position in the direction of a tangent line to both of the light-sensitive carrier and the developing roller at a contact position of the lighe-sensitive carrier and the developing roller, the load reactive force resulted from the contact with the light-sensitive carrier, which is received by the developing roller, does not work as an angular moment of the developing unit. For this reason, the fluctuation of pressing force of contact of the developing roller with the light-sensitive carrier can be prevented due to the load reactive force.

A further aspect of the process cartridge according to the present invention comprises an endless light-sensitive carrier, a charging means for charging the light-sensitive carrier, a cleaner for cleaning a residual toner on the light-sensitive carrier, a cartridge frame installed with at least the light-sensitive carrier, the charging means and the cleaner, a developing unit rotatably provided to the process cartridge around a rotary fulcrum, for developing an electrostatic latent image on the light-sensitive carrier by contacting a developing roller for supplying internal developer with the light-sensitive carrier, wherein the rotary fulcrum is disposed on a vertical line including the center of gravity of the developing unit.

A further aspect of the image forming apparatus according to the present invention comprises an endless light-sensitive carrier, a charging means for charging the light-sensitive carrier, an optical means for exposing the charged light-sensitive carrier to a light image, a cleaner for cleaning a residual toner on the light-sensitive carrier, a process cartridge installed with at least the light-sensitive carrier, the charging means and the cleaner, a developing unit rotatably provided to the process cartridge around a rotary fulcrum, for developing an electrostatic latent image on the light-sensitive carrier by contacting a developing roller for supplying internal developer with the light-sensitive carrier and a transfer means for transferring a toner image on the light-sensitive carrier onto a sheet, wherein the rotary fulcrum is disposed on a vertical line including the center of gravity of the developing unit.

With the above structure, since the rotary fulcrum of the developing unit is disposed on a vertical line including the center of gravity of the developing unit, it is possible to reduce the influence brought by the change of the center of gravity of the developing unit corresponding to the weight change at the right and left side positions to the central rotary fulcrum resulted from quantitative change of the developer in the developing unit. For this reason, it is possible to reduce the change of pressing force given from the developing roller against the light-sensitive carrier due to quantitative change of the developer.

A still further aspect of the image forming apparatus according to the present invention comprises an endless light-sensitive carrier, a charging means for charging the light-sensitive carrier, an optical means for exposing the charged light-sensitive carrier to a light image, a cleaner for cleaning a residual toner on the light-sensitive carrier, a process cartridge installed with at least the light-sensitive carrier, the charging means and the cleaner, a developing unit rotatably provided to the process cartridge around a rotary fulcrum, for developing an electrostatic latent image on the light-sensitive carrier by contacting a developing roller for supplying internal developer with the light-sensitive carrier and a transfer means for transferring a toner image on the light-sensitive carrier onto a sheet, and further comprises a gear provided to the developing unit for driving the developing roller, a driving gear engaged with a gear of the developing unit, wherein the direction of a resultant force consisting of a force in pressure angle direction and a force in a direction engaging into the gear is set toward the rotary fulcrum, and a driving means for driving the driving gear.

Since the developing unit and the driving system are separated, a force in pressure angle direction given by the driving gear of the driving system against the gear of the developing roller provided to the developing unit varies. Accordingly, pressing force of the developing roller against the light-sensitive carrier comes to change. In this structure, since the direction of the resultant force consisting of a force in pressure angle direction and a force in a direction engaging into the gear is set toward the rotary fulcrum, it allows to prevent the change in the pressing force given by the developing roller against the light-sensitive carrier based on the change of the force in pressure angle direction.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention.

DETAILED DESCRIPTION OF THE PREFERRED EMBODIMENTS

Figure 1A:
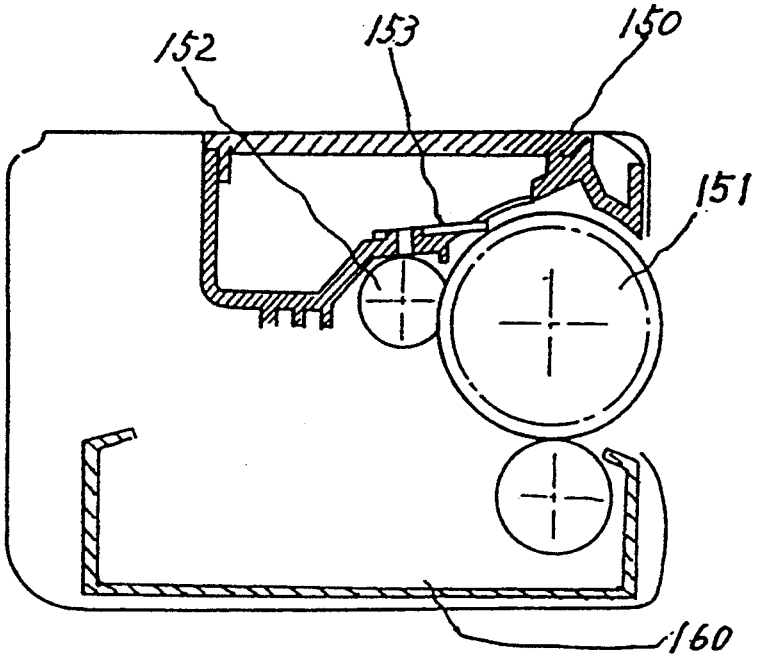
FIG. 1A PRIOR ART
FIGS. 1A and 1B are explanatory diagrams of prior art.
Figure 1B:
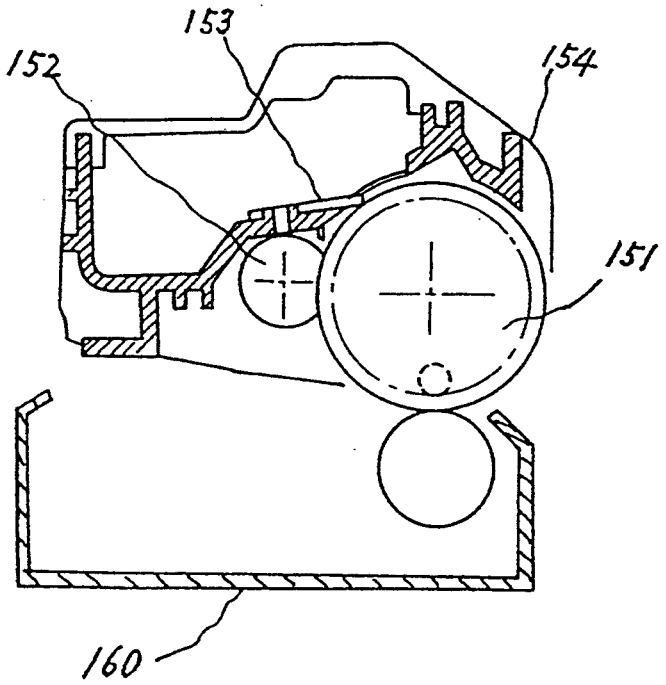
FIG. 1B PRIOR ART
Figure 2:
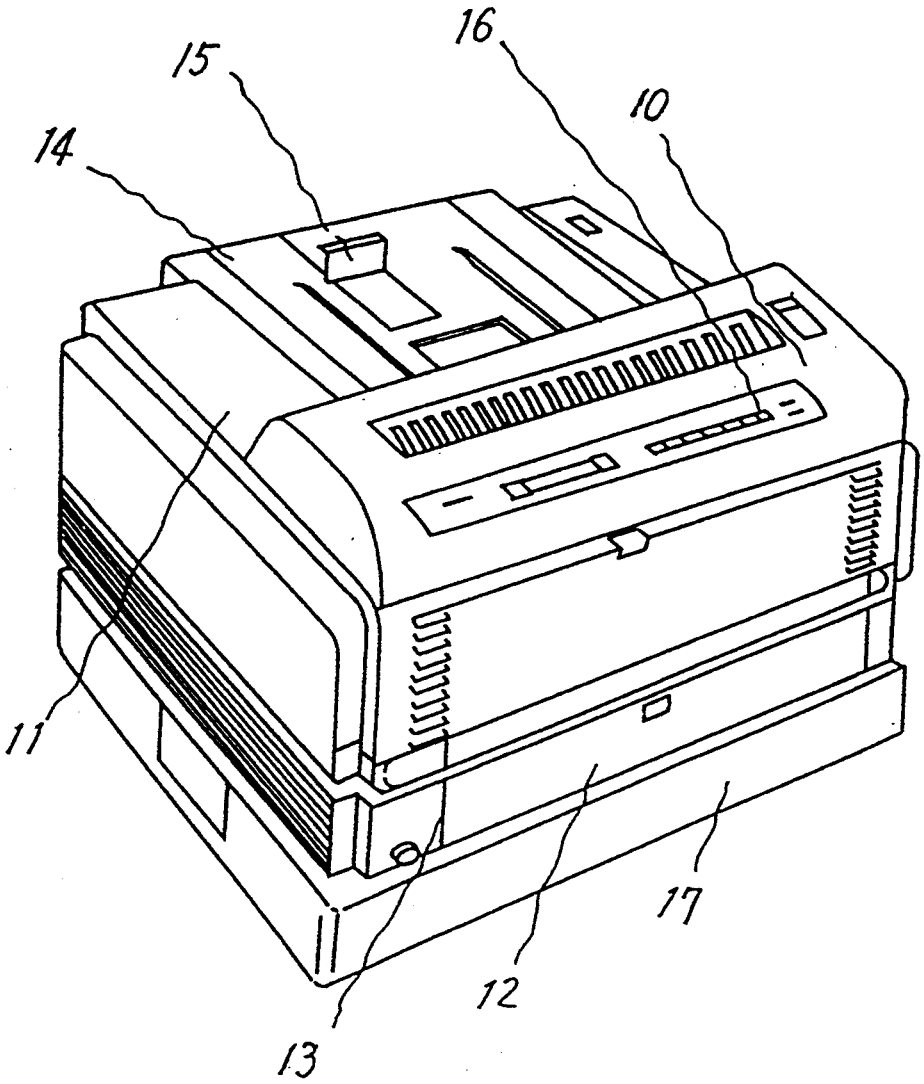
FIG. 2 is a perspective view showing the outline of an image forming apparatus according to one embodiment of the present invention.
Figure 3:
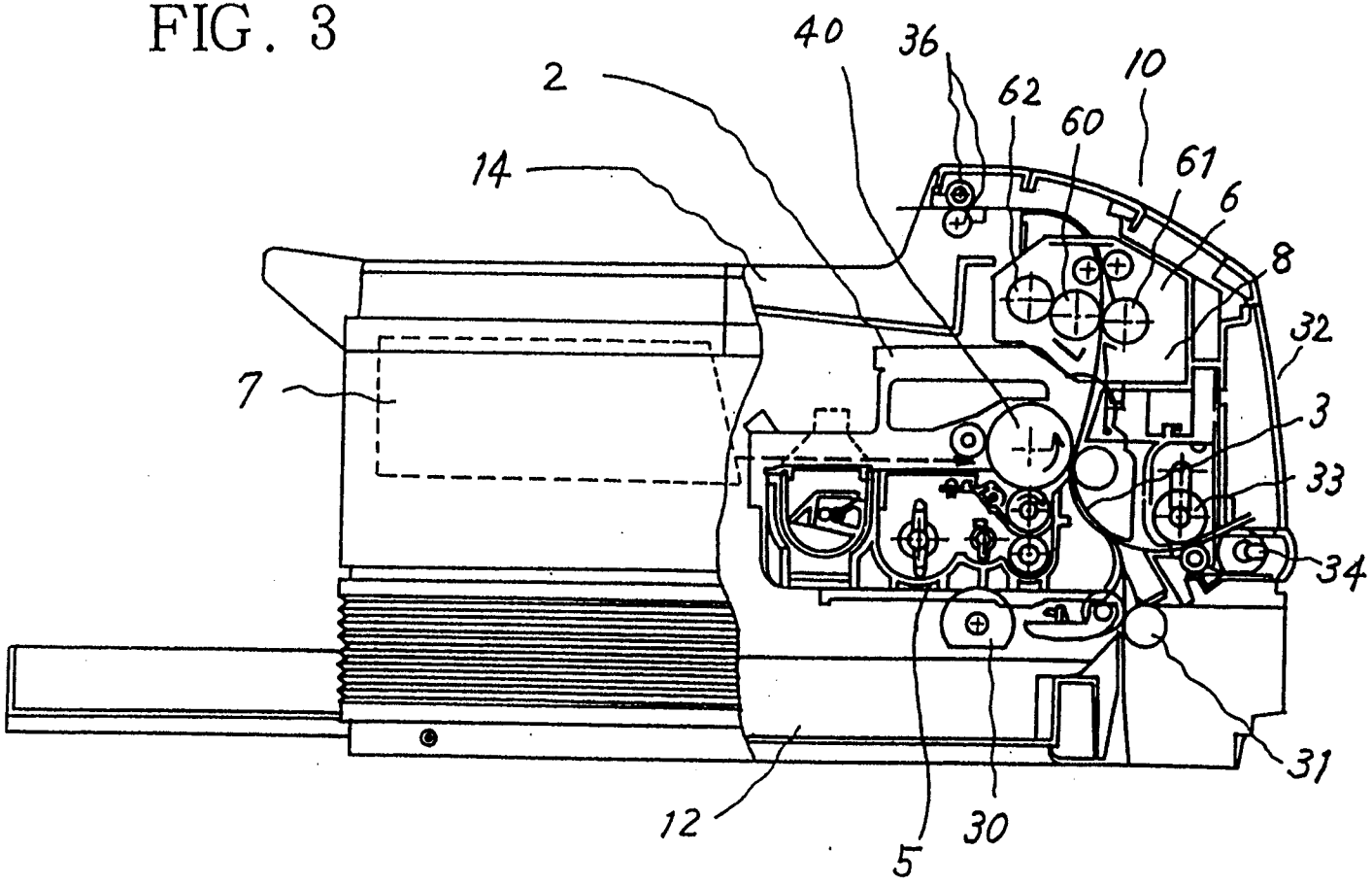
FIG. 3 is a cross-sectional view showing the interior of the image forming apparatus shown in FIG. 2.
Figure 4:
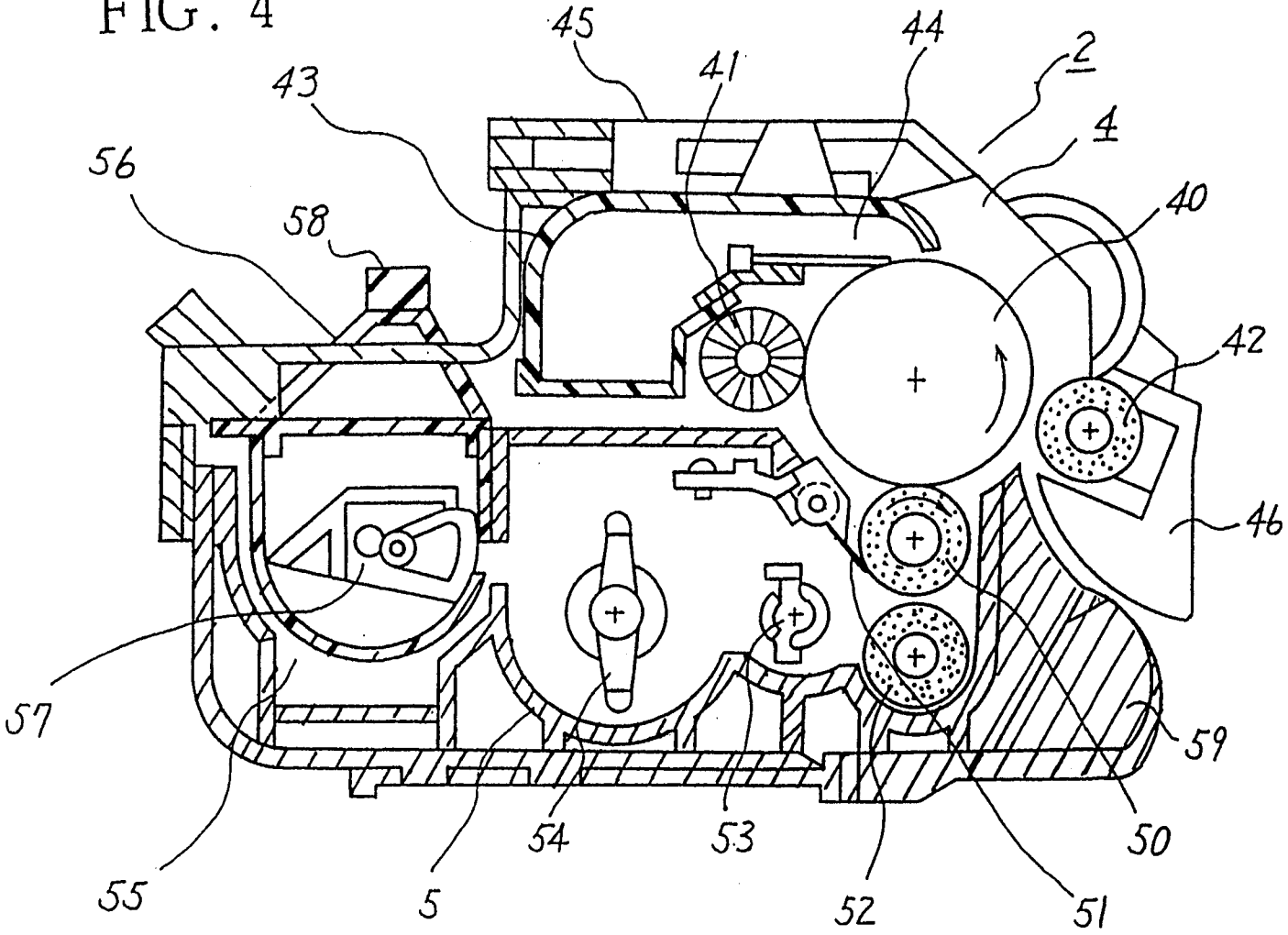
FIG. 4 is a cross-section of a process cartridge of the image forming apparatus shown in FIG. 3.
Figure 5:
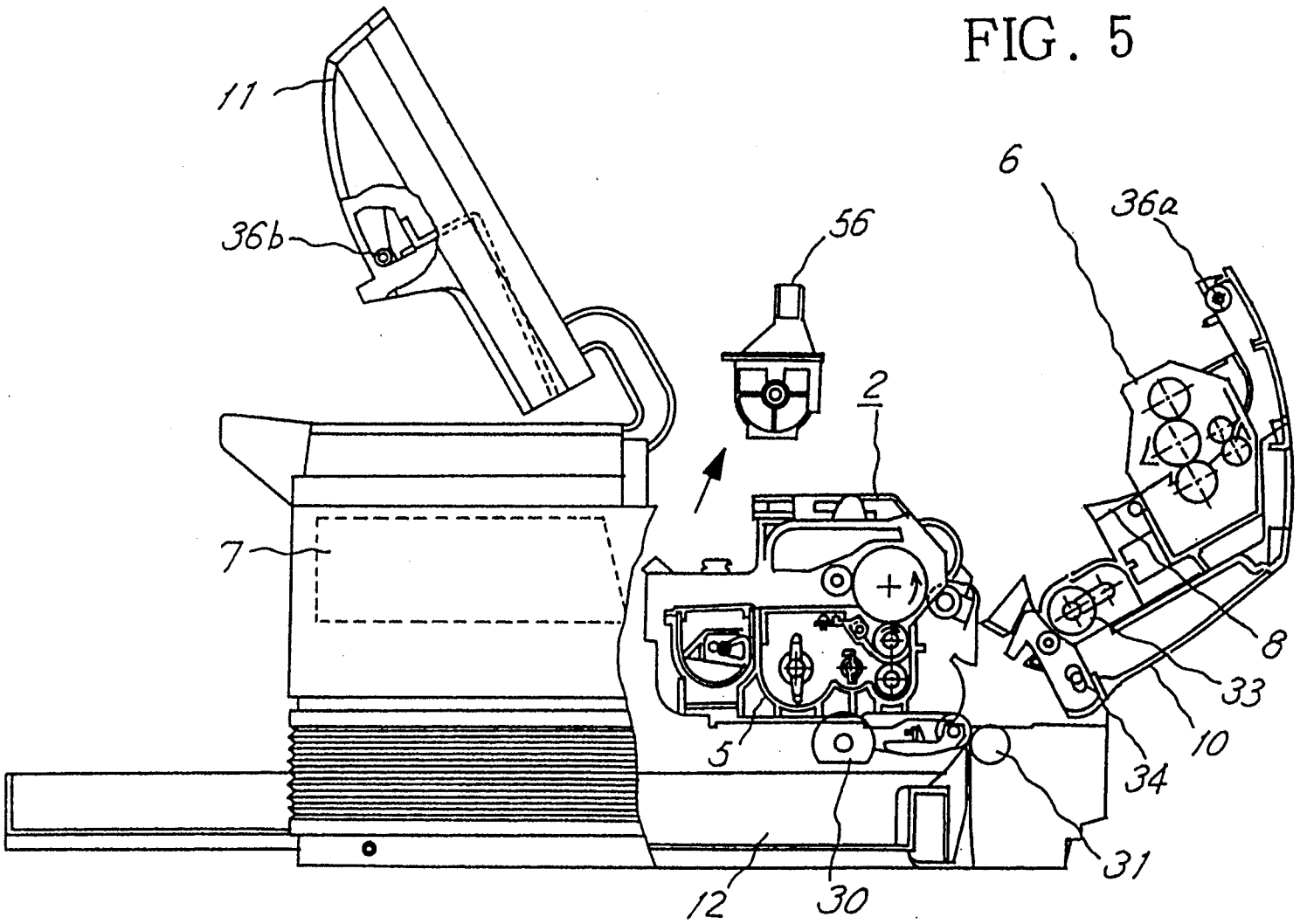
FIG. 5 is a diagram for illustrating the image forming apparatus in FIG. 3 of which covers are opened.
Figure 6A:
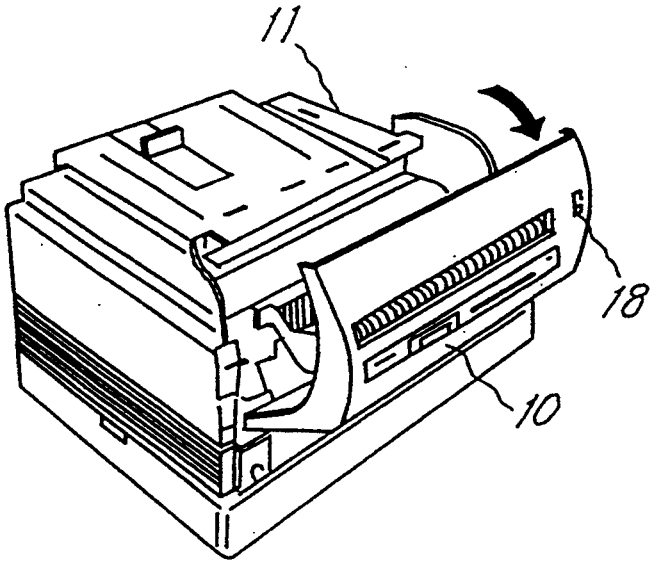
FIGS. 6A and 6B are diagrams for illustrating the image forming apparatus in FIG. 2 of which covers are opened.
Figure 6B:
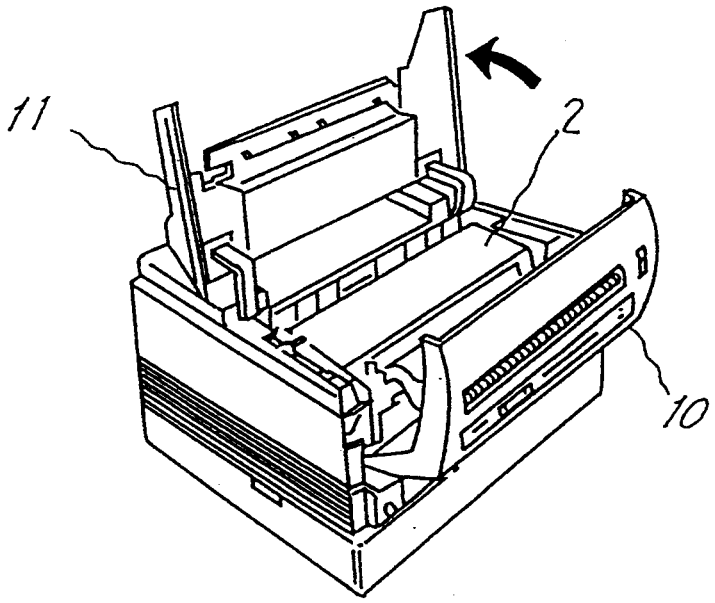
Figure 7:
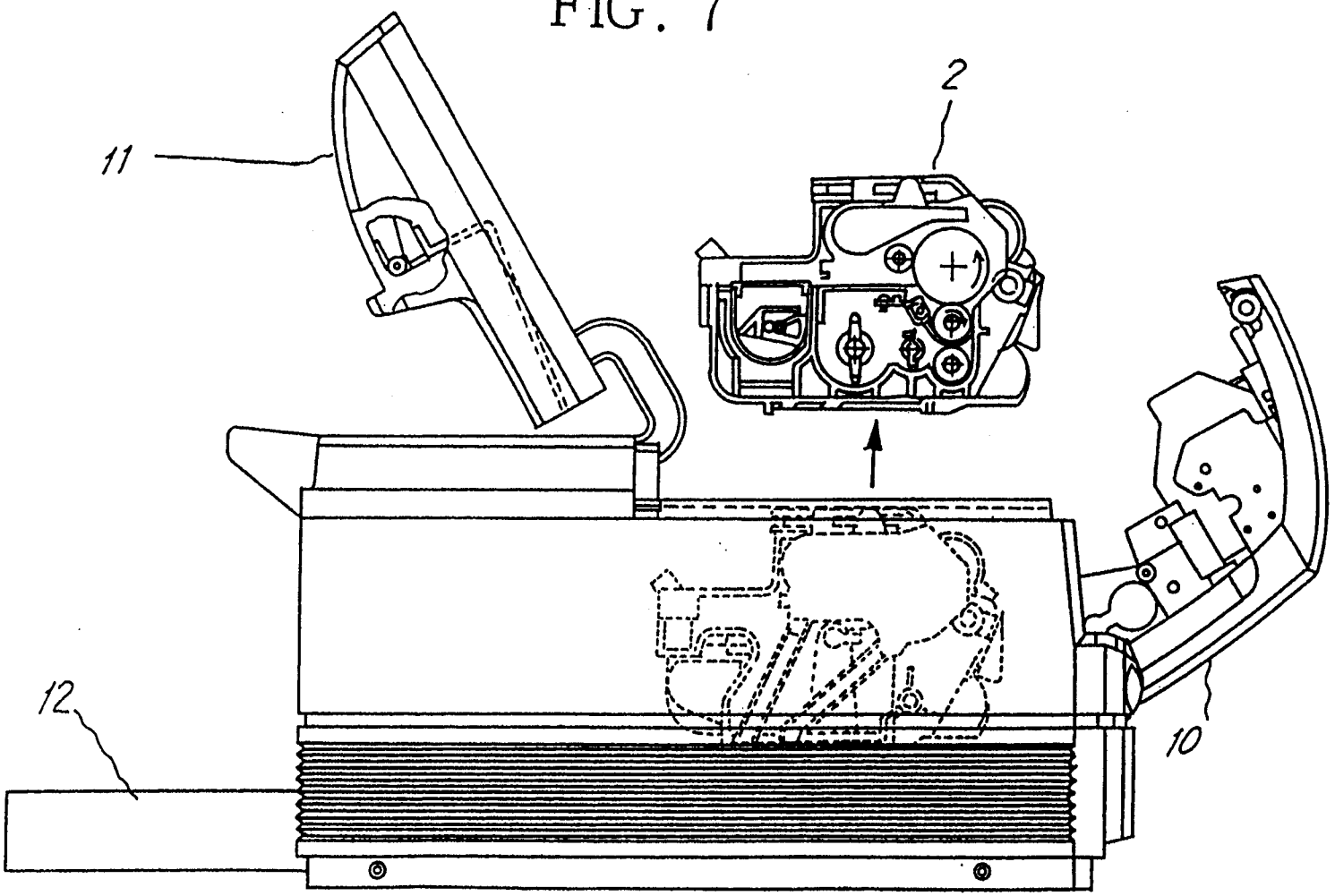
FIG. 7 is a diagram for explaining an exchanging operation of the process cartridge of the image forming apparatus in FIG. 3.

FIG. 2 is a perspective view showing the outline of an image forming apparatus according to one embodiment of the present invention, FIG. 3 is a cross-sectional view showing the interior of the image forming apparatus shown in FIG. 2, FIG. 4 is a cross-section of a process cartridge shown in FIG. 3, FIG. 5 is a diagram for illustrating the image forming apparatus in FIG. 3 of which covers are opened, FIG. 6A is a perspective view of the image forming apparatus of which front cover is opened, FIG. 6B is a perspective view of the image forming apparatus of which upper cover is opened, and FIG. 7 is a diagram for explaining the image forming apparatus of which both front and upper covers are opened.

The illustrated image forming apparatus is an electrophotographic printer. And FIG. 2 is a perspective view of the printing apparatus as viewed from the front. In FIG. 2, a front cover 10 is opened frontward of the apparatus to open a feeding path 3 shown in FIG. 3. An upper cover 11 covers the top of the apparatus, and is opened upward of the apparatus to open the top of the apparatus. A sheet cassette 12 is to be set in the apparatus from the front thereof. A cassette inserting port 13 is a port for inserting the sheet cassette 12 into the apparatus. A stacker 14 is provided on the top of the apparatus to receive printed sheets. A sheet guide 15 is provided on the stacker 14 to guide the sheet discharged on the stacker. An operation panel 16 is provided at a front cover 10 and has various switches and a display unit. A controller box 17 is provided at the bottom of the apparatus and accommodates printer control circuit, etc.

Referring to FIG. 3, an electrophotographic process cartridge 2 is provided above the sheet cassette 12 and will be described later with reference to FIG. 4. A thermal fixing unit 6 causes a sheet to be put through between a heat roller 60 and a backup roller 61 to fix a toner image on that sheet. This thermal fixing unit 6 is provided with a cleaning roller 62 for removing a toner from the heat roller 60. An optical unit 7 uses a polygon mirror to scan the photosensitive drum 40 with a beam from a semiconductor laser, which is driven according to image information, thereby writing an image on the photosensitive drum 40. The light image from the optical unit 7 passes above a developing unit 5 (which will be described with referring to FIG. 4) of the process cartridge 2 as indicated by a broken-lined arrow to irradiate the photosensitive drum 40 of the process cartridge 2. A sheet separator 8 has a discharge electrode to apply charges of the opposite polarity to that of the potential at the back of the sheet on which the toner image on the photosensitive drum 40 has been transferred. The discharge electrode deelctrifies the back of the sheet, thereby separating the sheet from the photosensitive drum 40.

A pickup roller 30 serves to pick up sheets in the sheet cassette 12. A resist roller 31 aligns the leading edge of the sheet picked up by the pickup roller 30, and feeds out the sheet. A manual-inserting guide 32 guides a manually inserted sheet to a feed roller 33 when opened rightward in the diagram. The feed roller 33 feeds the sheet guided by the manual-inserting guide 32 toward the photosensitive drum 40 of the process cartridge 2. Reference numeral "34" is the rotary shaft of the front cover 10. Discharge rollers 36 are provided at the top portion of the front cover 10 to discharge the sheet, passing through the thermal fixing unit 6, onto the stacker 14.

The process cartridge will now be described. As shown in FIG. 4, the process cartridge 2 comprises a drum cartridge 4 and a developing unit 5. The developing unit 5 is installed to the drum cartridge 4 by rods which will be described later with referring to FIG. 10, and can be separated therefrom by detaching the rods.

The structure of the drum cartridge 4 will now be described. In FIG. 4, the photosensitive drum 40 has an organic photosensitive layer (OPC or the like) formed on the surface of a cylindrical base made of alminum or the like, and is rotatable counterclockwise as shown. A brush charger 41 is constituted by wiring a conductive brush, which has conductive rayon fibers woven into the core, around the rotary shaft. The photosensitive drum 40 is uniformly charged to about −600 V by this brush charger 41. A transfer roller 42 is provided at the drum cartridge 4, and is made of a conductive porous rubber material, such as porous polyurethane foam (sponge). This transfer roller 42 is applied with a transfer voltage and is pressed against the photosensitive drum 40 to transfer the toner image on the photosensitive drum 40 onto a sheet. A waste toner box (cleaner) 43 scrapes a residual toner off the photosensitive drum 40 by using scraping blade 44 and receives the scraped toner. A handle 45 is provided to permit a user to carry the drum cartridge 4 with a hand. A roller cover 46 serves as a stopper for the transfer roller 42 and protect the roller 42.

The structure of the developing unit 5 will be described next. Referring to FIG. 4, a developing roller 50 comprises a conductive elastic roller, which is preferably made of a conductive porous rubber material, such as conductive porous polyurethane foam (sponge). The developing roller 50 rotates clockwise as shown in the diagram to supply a non-magnetic, one-component toner to the photosensitive drum 40 while holding the toner with the retentive force of its surface. This developing roller 50 is pressed against the photosensitive drum 50 with a predetermined nip width and is applied with a developing bias voltage of about −300 V. A layer-thickness restricting blade 51, which is made of a 0.1 mm thick stainless plate, serves to restrict the thickness of the toner layer on the developing roller 50 to a predetermined thickness. This layer-thickness restricting blade 51 is pressed against the developing roller 50 and is applied with a negative voltage of about −400 V. This applied voltage allows the layer-thickness restricting blade 51 to supply negative charges to the toner to forcibly charge the toner negatively at the time of restricting the thickness of the toner layer. Accordingly, the toner can be charged stably even under the condition of high humidity and high temperature. A reset roller 52 is made of a conductive sponge material. This reset roller 52 is disposed to face the developing roller 50 and rotates in the same direction as the developing roller 50. The reset roller 52 is applied with a bias voltage of −400 V to scrape the toner off the developing roller 50 in the right-hand side of the diagram and supply the toner to the developing roller 50 in the left-hand side of the diagram.

Paddle rollers 53 and 54 rotate to stir the non-magnetic, one-component toner in the developing unit 5 and charge the toner. In addition, the paddle rollers 53 and 54 supply the stirred toner toward the reset roller 52. A toner cassette retainer 55 retains a toner cassette 56, which contains the non-magnetic, one-component toner. This toner cassette 56 is detachably set to the toner cassette retainer 55. A toner supply lever 57 is provided in the toner cassette 56, and rotates to feed the toner in the toner cassette 56 into the developing unit 5. The toner cassette 56 is provided with a handle 58 to allow a user to hold the toner cassette 56 with a hand. Sheet guide ribs 59, together with the roller cover 46, form a path for guiding the sheet between the photosensitive drum 40 and the transfer roller 42.

In this embodiment, a U-shaped feeding path 3, which extends from the sheet cassette 12 and reaches the discharge rollers 36 through the process cartridge 2, is formed.

The function of this printer will be described with referring to FIGS. 2 through 4. A sheet in the sheet cassette 12 is picked up by the pickup roller 30 and abuts against the resist roller 31. After the leading edge is aligned by the resist roller 31, this sheet is fed toward the photosensitive drum 40 along the U-shaped feeding path 3. Meantime, when the picked sheet reaches the resist roller 31, the optical unit 7 starts exposing the photosensitive drum 40 to image light. As a result, the potential at the image-exposed portion of the photosensitive drum 40, which has been charged to −600 V by the brush charger 41 comes to zero, thus forming an electrostatic latent image corresponding to the image to be copied.

Since a bias voltage of −300 V is applied to the developing roller 50 in the developing unit 5, the negatively charged toner sticks on the image-exposed portion with zero potential of the photosensitive drum 40, forming a toner image thereon. The toner image on the photosensitive drum 40 is transferred onto the sheet, fed by the resist roller 31, by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is fed to the thermal fixing unit 6 where the toner image on the sheet is thermally fixed by the heat roller 60. The image-fixed sheet is then discharged on the stacker 14 by the discharge rollers 36.

A sheet manually inserted through the manual-inserting guide 32 pulled open is likewise conveyed toward the photosensitive drum 40 by the feed roller 33. The toner image on the photosensitive drum 40 is transferred onto the sheet by the transfer roller 42 due to the electrostatic force and pressure. The sheet electrostatically adsorbed to the photosensitive drum 40 is separated from the photosensitive drum 40 by the charges supplied by the sheet separator 8. The separated sheet is then fed to the thermal fixing unit 6 where the toner image on the sheet is thermally fixed by the heat roller 60. The resultant sheet is then discharged on the stacker 14 by the discharge rollers 36.

In the diagram illustrating the apparatus in FIG. 5 of which front and upper covers are opened, the front cover is opened around the cover rotary shaft 34 in right-hand frontward of the diagram. Provided on this front cover 10 are the manual-inserting guide 32, the feed roller 33, the sheet separator 8, the thermal fixing unit 6 and an upper discharge (drive) roller 36*a* of the discharge roller pair 36. The upper cover 11 is opened upward of the apparatus (upward in the diagram) around a rotary shaft which is not shown. A lower discharge (pinch) roller 36*b* of the discharge roller pair 36 is provided on the upper cover 11.

Consequently, as shown in FIGS. 6A and 5, when the front cover 10 is opened by unlocking a lock lever 18 of the front cover 10, the U-shaped feeding path 3 extending from the resist roller 31 to the discharge rollers 36 is opened, making it easier to remove any jammed sheet. If the transfer roller 42 is shifted from the proper position facing the photosensitive drum 40, i.e., if there is a shift in parallelism and position to the photosensitive drum 40, image transfer cannot be executed properly. In this respect, the transfer roller 42 is provided to the process cartridge 2. Although this design does not open the space between the photosensitive drum 40 and the transfer roller 42, a jammed sheet can easily be removed without any problem even if that portion does not become free.

Similarly, the reason why the whole thermal fixing unit 6 is provided on the front cover 10 is that if the thermal fixing unit 6 was divided to open the feeding path, a part of the thermal fixing unit 6 should be provided above the process cartridge 2, thus inconveniencing a user to pull out the process cartridge 2. Although this design does not open the space between the heat roller 60 of the thermal fixing unit 6 and the backup roller 61, a jammed sheet can easily be removed without any problem even if that portion does not become free.

In the operation of opening the cover 10 and 11, as shown in FIG. 2, the front cover 10 is provided above the upper cover 11 at the sheet discharging portion so that the upper cover 11 does not become free unless the front cover 10 is opened. When the front cover 10 is opened and the upper cover 11 is opened next as shown in FIG. 6B, therefore, the top portion of the apparatus and a part of the front portion of the apparatus are opened as shown in FIG. 5. Accordingly, the toner cassette 56 can easily be detached or attached from the front side of the apparatus while keeping the process cartridge 2 installed in the apparatus, thus allowing for the exchange of the toner cassette 56 alone.

As the front side of the apparatus is opened by opening the front cover 10 and the top portion of the apparatus is opened by opening the upper cover 11 as shown in FIG. 7, the attachment and detachment of the process cartridge 2 can also be performed easily. Even if the process cartridge 2 is large, therefore, the exchange is easy. In other words, the process cartridge 2 can be designed large, particularly, the developing unit 5 in the process cartridge 2 can be designed large, so that the quantity of the retainable developer can be increased, thus allowing the exchanging cycle of the developing unit 5 to be significantly longer.

Further, since the developer can be supplemented through the exchange of the cassette 56 alone, the exchanging cycle of the developing unit 5 can be made longer. Furthermore, as the covers 10 and 11 are opened separately from the discharge rollers 36, which is provided separately from the covers 10 and 11, the entire U-shaped feeding path 3 can be opened, thus facilitating removal of a jammed sheet.

Figure 8:
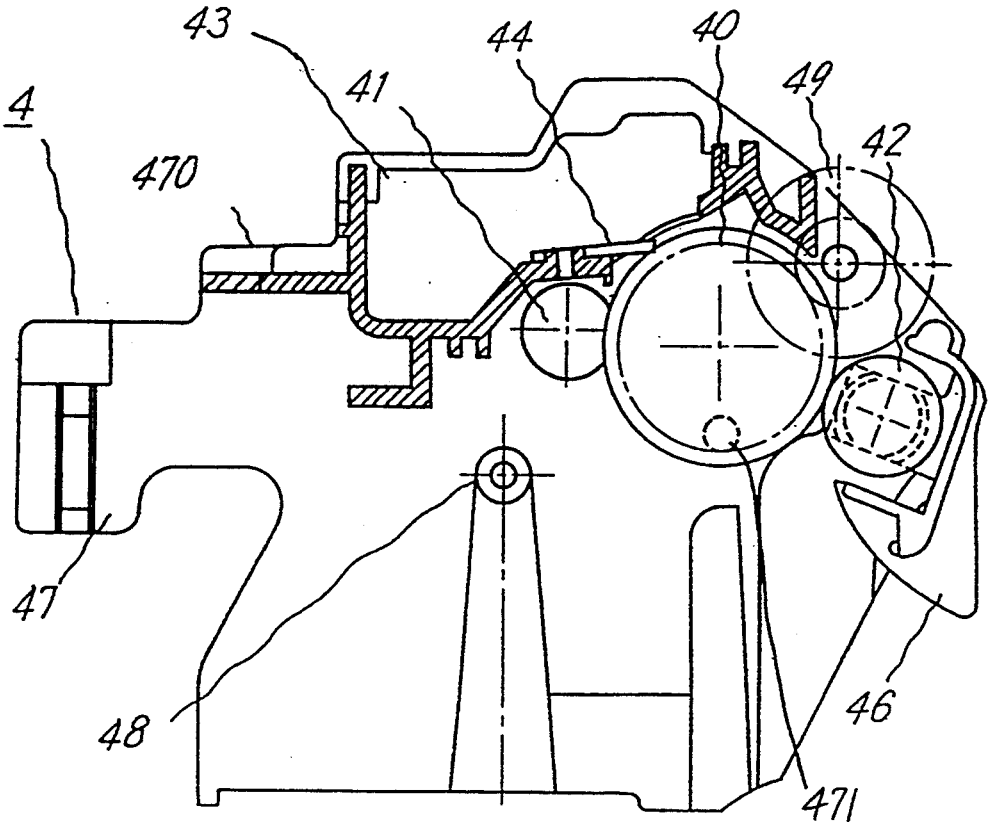
FIG. 8 is a cross-sectional view of the exploded process cartridge in FIG. 4.
Figure 8:
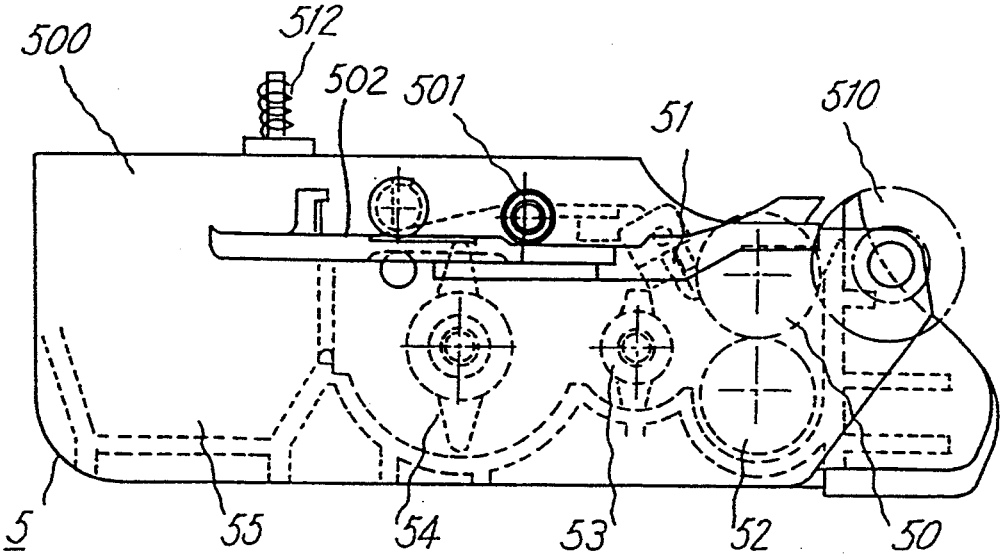
Figure 9:
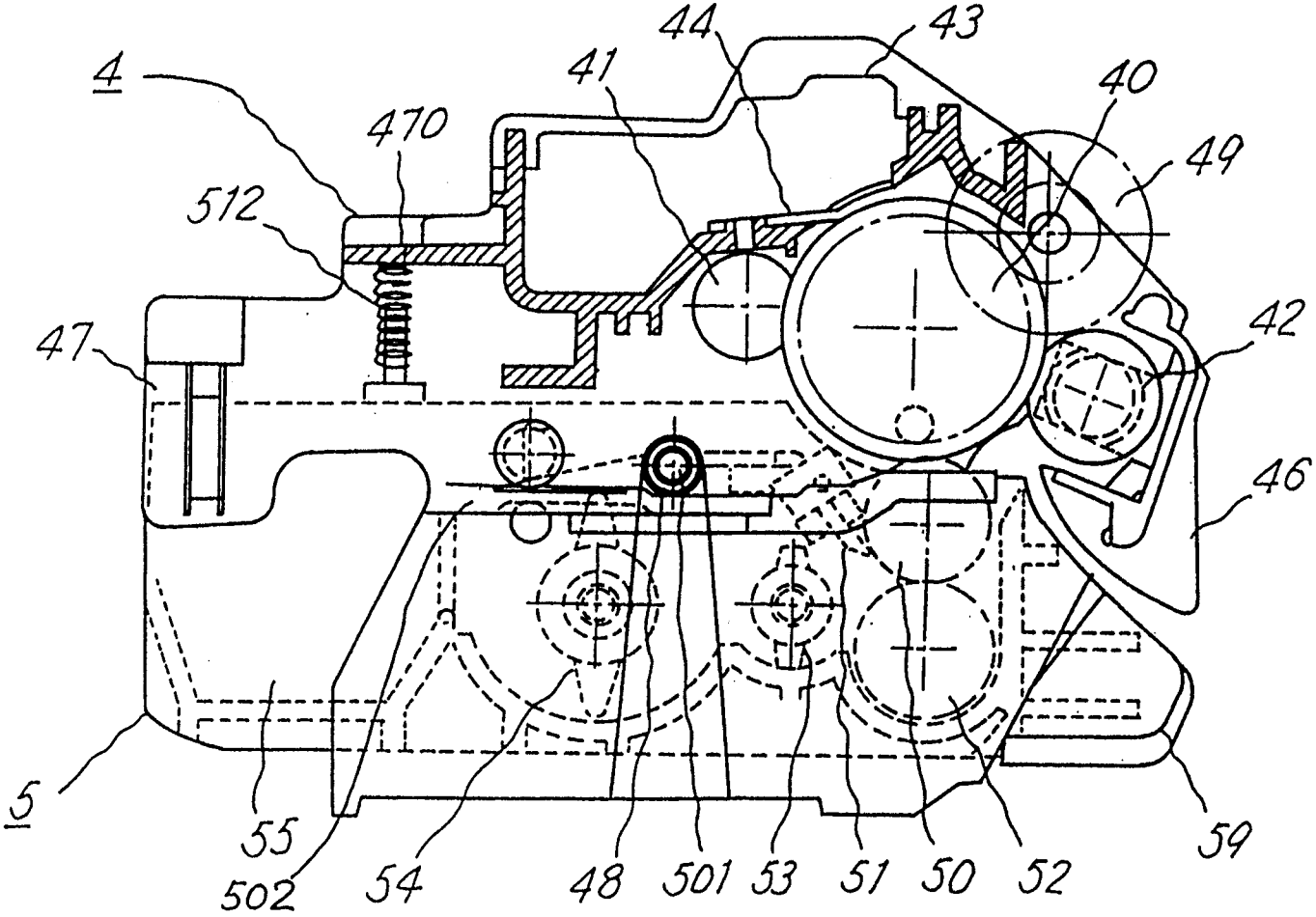
FIG. 9 is a cross-sectional view of the process cartridge incorporated with the developing unit in FIG. 8.
Figure 10:
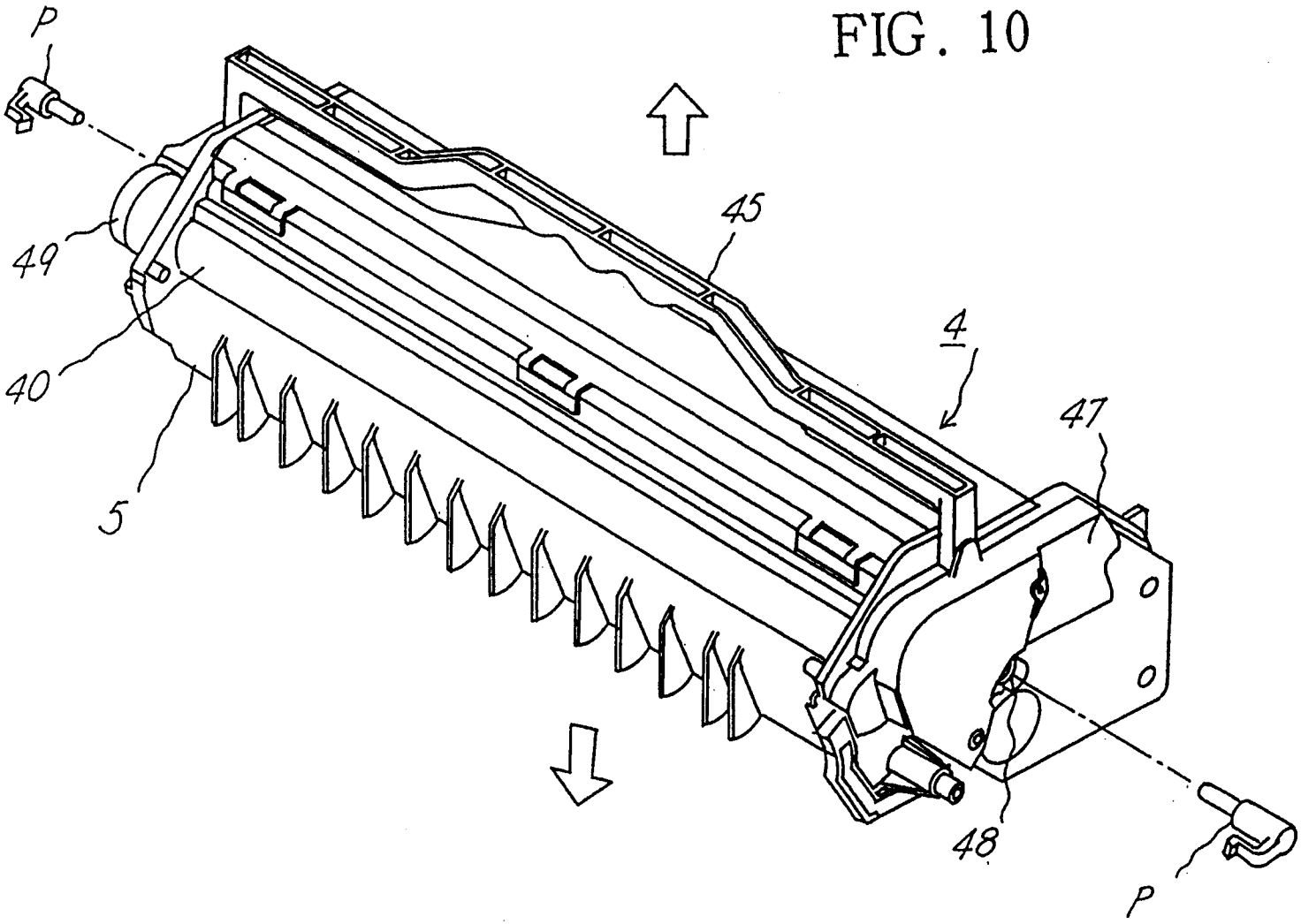
FIG. 10 is a perspective illustration of the process cartridge in FIG. 9.
Figure 11:
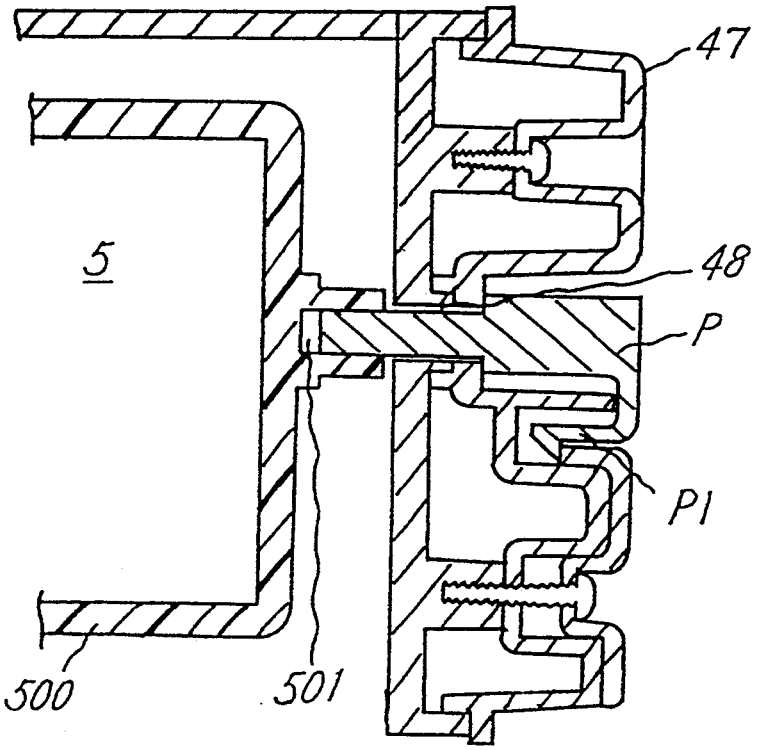
FIG. 11 is a cross-sectional view for illustrating the incorporation mechanism of the process cartridge in FIG.9.
Figure 12:
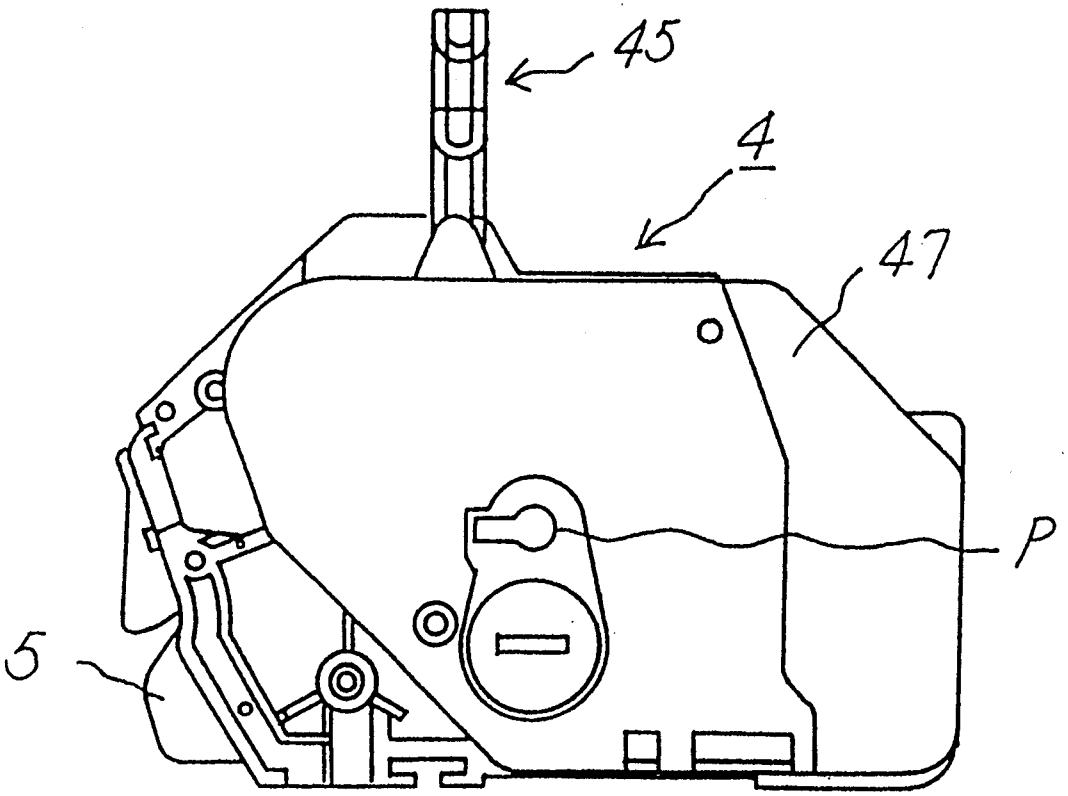
FIG. 12 is a side view of the process cartridge in FIG. 9.

The detachment and the attachment structure of the process cartridge and the developing unit will now be described. FIG. 8 is a side view of the exploded process cartridge in FIG. 4, FIG. 9 is a sectional view of the incorporated process cartridge in FIG. 8, FIG. 10 is a perspective view for explaining the incorporating mechanism of the process cartridge in FIG. 8, FIG. 11 is a sectional view of the essentials of the incorporating mechanism of the process cartridge in FIG. 10, and FIG. 12 is a side view of the incorporated process cartridge.

As shown in FIG. 8, the drum cartridge 4 contains a cartridge frame 47. On the upper part of the cartridge frame 47, the photosensitive drum 40, the brush charger 41, the transfer roller 42, the waste toner box 43, a roller cover 46, a driving gear 49 of the photosensitive drum 40 and a stopper block 470 where a pressing spring of the developing unit 5 is blocked are provided. And the lower part of the cartridge frame forms the retainer of the developing unit 5. Further, in the middle of the cartridge frame 47, a fulcrum hole 48 to be inserted with a connection rod P shown in FIG. 10 is provided.

The developing unit 5 contains a developing unit frame 500 which forms the side plate of the developing unit 5. In the middle of this developing unit frame 500, a free fit hole 501 to be freely fitted with the connection rod P is provided. A driving gear 510 is provided on the right end position of the developing unit frame 500. A pressing spring (coil spring) 512 is provided at the left-hand side of the free fit hole 501 in the developing unit frame 500. Further, an evacuation lever 502 which moves right and left-hand directions in the diagram is provided at the side of the developing unit frame 500. When this evacuation lever 502 is driven toward the left-hand direction in the diagram, the tip thereof links to a fixing rod 471 of the drum cartridge 4, thereby rotatably moving the developing unit 5 clockwise around the free fit hole 501 (rotary fulcrum) to evacuate the developing roller 50 from the photosensitive drum 40.

The developing unit 5 is inserted into the drum cartridge 4 through the lower side thereof, thereafter the free fit hole 501 of the developing unit 5 is positioned to the fulcrum hole 48 of the drum cartridge 4. Then the connection rod P is inserted to the fulcrum hole 48 of the cartridge frame 47 in the drum cartridge 4 from both sides of the hole 48 as shown in FIG. 10. Accordingly, the connection rod P penetrates through the fulcrum hole 48 of the drum cartridge 4 and is then freely fitted to the free fit hole 501 of the developing unit 5, as shown in FIG. 11A. The connection rod P is filed to the cartridge frame 47 by hanging a hook portion of the rod P on a block P1.

As shown in FIGS. 9 and 12, the developing unit 5 is accommodated into the drum cartridge 4, being installed and incorporated thereto. From this moment, the developing unit 5 becomes rotatably movable around the connection rod P as a result of the free fit of the connection rod P to the free fit hole 501. The pressing spring 512 of the developing unit 5 runs into the connection block 470 of the drum cartridge 4, thereby a counterclockwise angular moment around the fulcrum is given to the developing unit 5, then allowing the developing roller 50 to press the photosensitive drum 40, as shown in FIG. 9.

Accordingly, the positioning of the developing roller 50 and the photosensitive drum 40 can be accomplished by positioning the free fit hole 501 of the developing unit 5 to the fulcrum hole 48 of the drum cartridge 4, thereby making unnecessary to provide the positioning mechanism.

For the detachment of the developing unit 5 from the drum cartridge 4, the connection rod P is pulled out from the fulcrum hole 48 of the cartridge frame 47 in the drum cartridge 4 by unlocking the blocker P1 of the connection rod P. Accordingly, the attachment of the developing unit 5 to the drum cartridge 4 is unlocked, thereby the drum cartridge 4 and the developing unit 5 are separated as shown with arrows in FIG. 10.

As described above, the drum cartridge 4 and the developing unit 5 can be incorporated and separated, thus allowing to detach the incorporated unit 2 from the apparatus and attach it to the apparatus by using the handle 45 of the drum cartridge 4 incorporated with the developing unit 5 with a hand, as shown in FIG. 12.

For the exchange of the developing unit 5 alone according to the structure described above, the process cartridge 2 is pulled out from the apparatus, then pulling out the connection rod P, thereby separating the developing unit 5 from the drum cartridge 4. Then a new developing unit 5 is inserted into the drum cartridge 4, and inserting the connection rod P thereto, then installing the developing unit 5 to the drum cartridge 4. By setting the incorporated process cartridge 2 to the apparatus, the exchange of the developing unit 5 alone can be performed.

For the exchange of drum cartridge 4 alone, the process cartridge 2 is removed from the apparatus, and pulling out the connection rod P, thereby separating the developing unit 5 from the drum cartridge 4. The developing unit 5 is then inserted into a new drum cartridge 4, and the connection rod P is inserted into the drum cartridge 4, then the developing unit 5 is installed into the drum cartridge 4. By setting the incorporated process cartridge 2 to the apparatus, the exchange of the drum cartridge 4 alone can be performed.

Similarly, for the exchange of both drum cartridge 4 and developing unit 5 at the same time, the process cartridge 2 incorporated with the developing unit 5 is pulled out from the apparatus, and a new process cartridge 2 is set to the apparatus, thereby allowing the exchange of the drum cartridge 4 and the developing unit 5 at the same time.

In any case above, the attachment and the detachment from the apparatus can be performed by single exchanging operation with process cartridge 2 as an unit for exchanging, thus allowing the exchanging operation easier. Alternatively, by making the developing unit 5 separable, the positioning of the developing unit 5 to the photosensitive drum 40 becomes unnecessary. Moreover, the developing unit 5 can be attached to the cartridge 4 by the insertion of the rod P and detached from the cartridge 4 by pulling out the rod P. As described above, by employing a simple mechanism and with simple operation, the attachment and the detachment of the developing unit 5 become possible.

Figure 13:
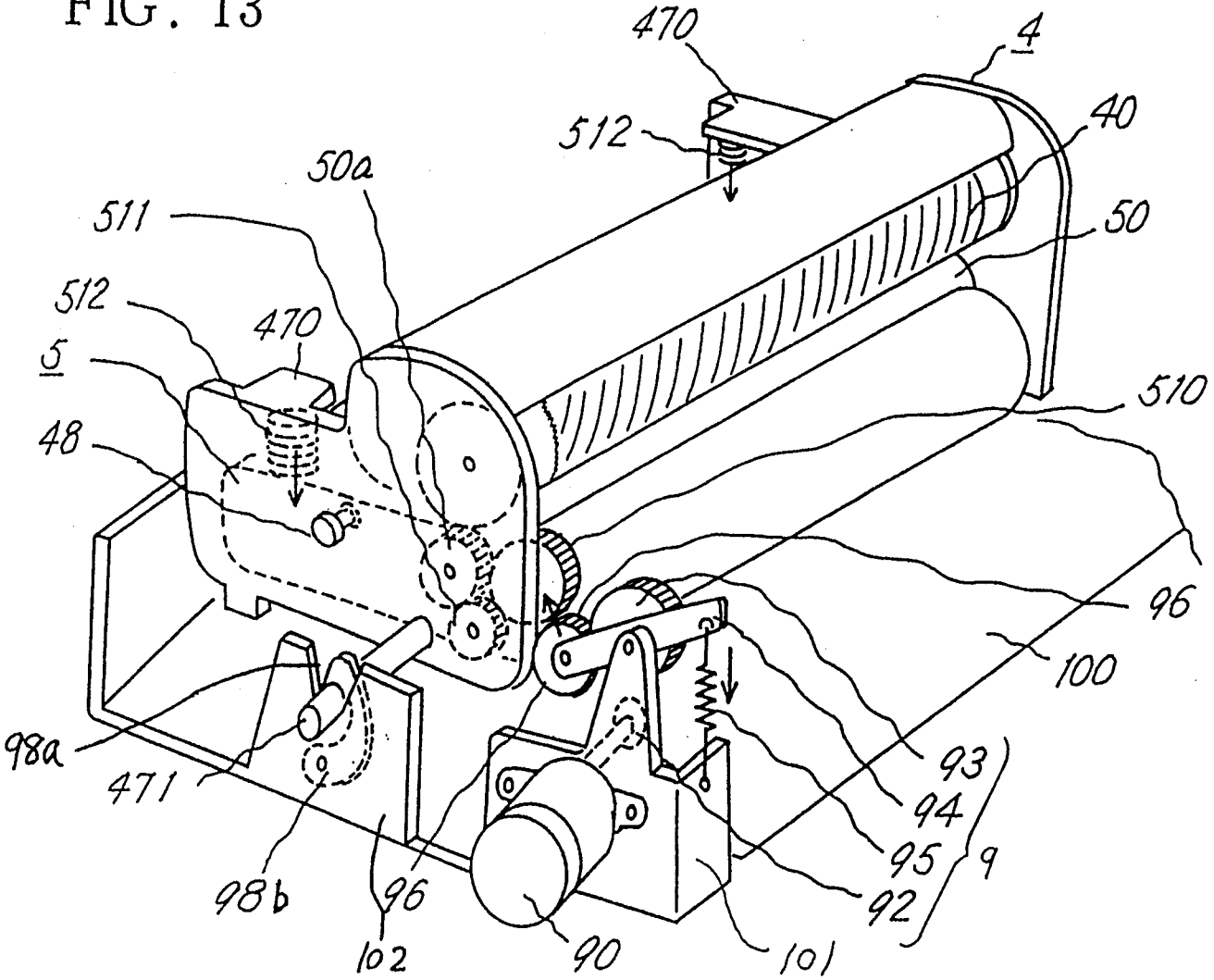
FIG. 13 is a perspective diagram for explaining the driving mechanism of the developing unit.

The fulcrum of the developing unit 5 will now be described with referring to FIGS. 13 and 14. FIG. 13 is a perspective view for explaining the driving mechanism of the developing unit, and FIG. 14 is a cross-sectional view for explaining the driving mechanism of the developing unit.

Referring to FIG. 13, the driving mechanism 9 for driving the developing unit 5 is provided to a base frame 100 of the apparatus. According to the driving mechanism 9, a developing unit driving motor 90 is provided to a motor installing frame 101 of the base frame 100. A motor gear 92 is provided to the shaft of the motor 90. Further, a body gear 93 which engages with the motor gear 92 is provided to the installing frame 101. A lever 94 is provided to the shaft of the body gear 93. A spring 95 which activates the lever 94 clockwise is provided at an end of the lever 94, and a planet gear 96 which engages with the body gear 93 is provided at the other end of the lever 94. This planet gear 96 engages with the driving gear 510 of the developing unit 5.

A unit supporting frame 102 is provided in the middle of the base frame 100. A positioning groove **98*a* and a connection rod 98*b* are provided on the unit supporting frame 102. A unit positioning rod (fixing rod) 471 of the drum cartridge 4 is freely fitted to the positioning groove 98*a* and connected by the connection rod 98*b*, thereby supporting the drum cartridge 4**.

Figure 14:
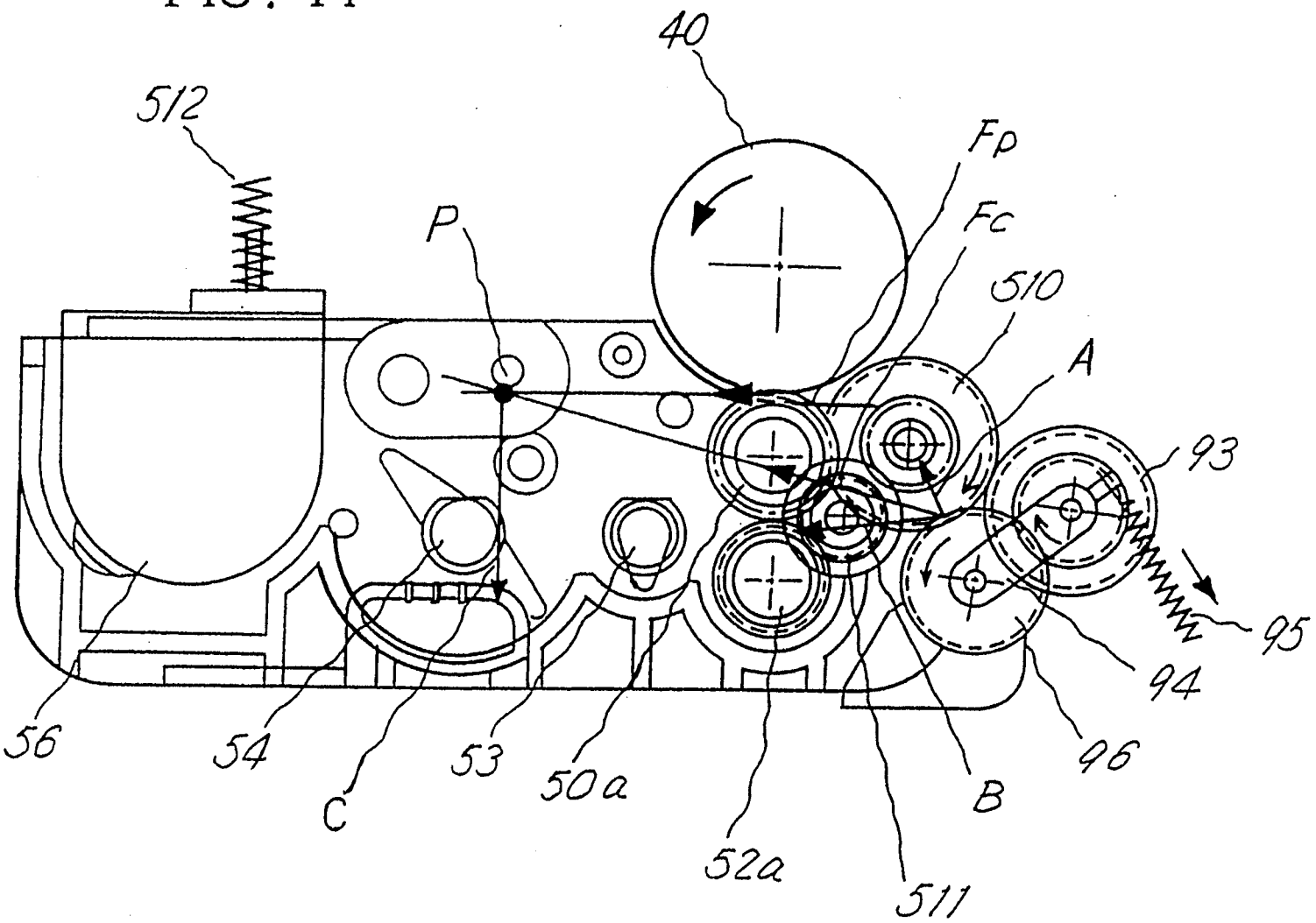
FIG. 14 is a cross-sectional view for explaining the driving mechanism of the developing unit.

As shown in FIGS. 13 and 14, the developing unit 5 is provided a driving gear 510 for engaging with the planet gear 96 of the driving mechanism 9, an intermediate gear 511 for engaging with the driving gear 510, a developing roller gear **50*a* for engaging with the intermediate gear 511 and provided to the shaft of the developing roller 50, a reset roller gear 52*a* for engaging with the intermediate gear 511 and provided to the shaft of the reset roller 52, and a gear train, which is not shown, for engaging with the reset roller gear 52*a* and rotating the paddle rollers 53 and 54 and a supply lever 57 of the developer cassette 56**.

With the above structure, when the process cartridge 4 is set in the apparatus, a rotating moment of the motor 90 is transmitted to the driving gear 510 of the developing unit 5 through gears 92, 93 and 96. In the developing unit 5, the developing roller gear **50*a* is driven by the driving gear 510 through the intermediate gear 511, thereby rotating the developing roller 50 clockwise. The intermediate gear 511 drives the reset roller gear 52*a*, thereby rotating the reset roller 52, paddle rollers 53 and 54, and the supply lever 57**.

In this case, when the process cartridge 2 is installed in the apparatus, the change in position between the shaft of the driving gear 510 of the developing unit 5 and the shaft of the planet gear 96 at the apparatus side occurs due to a dispersion in positioning of the process cartridge 2. For preventing this change, the planet gear 96 is pressed by the lever 94 toward the direction to which the gear 96 engages with the driving gear 510 (direction of an arrow in FIG. 13).

As described above, the developing unit 5 is rotatably movable around the connection rod P as a fulcrum to the drum cartridge 4 containing the photosensitive drum 40. At the time of printing, a angular moment is given by the pressing spring 512 so as to contact the developing roller 50 with the photosensitive drum 40. When no printing is performed, the evacuation lever 502 (see FIG. 8) driven by a evacuation driving source (not shown) runs into the fixing pin 471 of the drum cartridge 4, thereby separating the developing roller 50 from the photosensitive drum 40 in resisting the pressure of the pressing spring 512 in the developing unit 5.

A spacer roller (not shown)is provided to a shaft where the developing roller 50 is also provided to obtain a prescribed value of contacting quantity in the circumferential direction of both of the developing roller 50 and the photosensitive drum 40. Based on the contact between the spacer roller and the photosensitive drum 40, the distance between the axial center of the developing roller 50 and that of the photosensitive drum 40 is determined, thereby determining the deformation quantity, i.e., contacting quantity, of the developing roller 50.

In the above structure, the photosensitive drum 40 and the developing roller 50 are respectively provided in the drum cartridge 4 and the developing unit 5. As the drum cartridge 4 is rotatably moved around the fulcrum (fixing rod) 471 (see FIG. 13) and the developing unit 5 is rotatably moved around the fulcrum (connection rod) P, each driving force is separately applied from the apparatus side.

For this reason, the pressing force given by the developing roller 50 of the developing unit 5 against the photosensitive drum 40 is influenced by a force in pressure angle direction (an operating force of the driving gear) to be applied by the planet gear 96, located in the apparatus side for driving the developing unit 5, to the driving gear 510 of the developing unit 5. As described above, the force in pressure angle direction varies due to the engagement of the planet gear 96 with the driving gear 510, so that the pressing force given by the developing roller 50 changes. As a result, the abration of the spacer roller or insufficient developing due to the apartment of the developing roller 50 from the photosensitive drum 40 possibly occurs.

As shown in FIG. 14, a force given by the planet gear 96 to the driving gear 510 consists of a force A in pressure angle direction (an operating force of the driving gear 510 ) of the planet gear 96 which provides the driving force required for rotatably driving the developing roller 50 of the developing unit 5 and a force B in the direction to which the planet gear 96 engages into the driving gear 510 of the developing unit 5 (a gear driving force). The position of the fulcrum (connection rod) P is therefore determined so as to make a resultant force Fc, consisting of the force A in pressure angle direction and the force B in engaging direction, direct for the fulcrum P of the developing unit 5. To the contrary, the same can be realized by setting the position of the planet gear 96 in the above manner in the place of the fulcrum P.

Since the resultant force Fc directs to the fulcrum P, the angular moment around the fulcrum P is not generated due to the force A in pressure angle direction, the change in the pressing force of the developing roller 50 caused by the force in pressure angle direction can be prevented.

In a contact developing system, it is necessary to maintain the difference between the circumferential speed of the photosensitive drum 40 and that of the developing roller 50. Namely, the circumferential speed of the developing roller 50 is set to be faster than that of the photosensitive drum 40, whereby stabilizing the adsorption of toner. For this reason, a load reactive force Fp like a rotary brake is generated in the developing roller 50 by the contact of the photosensitive drum 40 during the developing operation.

The load reactive force Fp also brings the change of the pressing force of the developing roller 50 against the photosensitive drum 40. For this reason, the fulcrum P of the developing unit 5 is positioned in the direction of a brake load received by the developing roller 50 from the photosensitive drum 40 during its rotation, that is a direction of a tangent line to both of the photosensitive drum 40 and the developing roller 50 at the position where the developing roller 50 the photosensitive drum 40, as shown in FIG. 14. By the means, the generation of the angular moment around the fulcrum P is prevented by applying the load reactive force Fp, whereby preventing the change in the pressing force of the developing roller 50.

Furthermore, in the developing unit 5, the center of gravity of the developing unit 5 changes according to the quantity of the developer in the developing unit 5, whereby bringing the changes of the pressing force of the developing roller 50 in a case of rotatably moving type developing unit. For this reason, the position of the rotary fulcrum P of the developing unit 5 is disposed on a vertical line including the center of gravity of the developing unit 5, as shown in FIG. 14. With the above structure, the influence derived from the change of the position of the center of gravity of the developing unit 5 according to the change in the quantity of the developer in the developing unit 5 is reduced, whereby the change in the pressure which the developing roller 50 presses the photosensitive drum 40 can be reduced.

As shown in FIG. 14, the position of the pressing spring 512 which is a pressure means for giving the angular moment to the developing unit 5 is symmetrical around the fulcrum P to the position of contact of the photosensitive drum 40 with the developing roller 50. In this way, the reactive force which the developing roller 50 receives from the photosensitive drum 40 and the pressing force of the pressing spring 512 can be balanced around the fulcrum P, thereby stabilizing the pressing force of the developing roller 50.

As shown in FIG. 13, the pressing springs 512 of the developing unit 5 are provided as a coil spring at the both sides of the developing unit 5. In this way, it is possible to apply a pressure at both sides in the printing width direction of the developing unit 5, thus allowing to absorb the pressure difference between both sides of the developing unit 5 due to the twisting of the developing unit 5.

Further to the above embodiments, the following modifications can be applied to the present invention. As the first modification, for sheets PP, it is possible to use other printing media instead of normal sheet of paper. As the second, although a printer was exemplified as an image forming apparatus in the above embodiments, other image forming apparatus such as copy machines, facsimiles and the like are also applicable. As the third, although the developing unit was explained with non-magnetic, one-component developer, known developers such as magnetic, one-component or two-components developer can also be applied. As the fourth, the light-sensitive carrier other than in drum-shaped such as other endless carriers including endless belt-shaped carrier can be applied, and the charging means other than a brush charger like a corotron etc. can be applied.

As described above, according to the present invention, since the developing unit is removably provided to the drum cartridge provided with a light-sensitive carrier, a charging means and a cleaner, the exchangings of any of a developing unit alone, a drum cartridge and the both can be attained by one time operation of attachment and detachment from the apparatus. It can therefore serve for effective utilization of resources, while allowing the exchanging operation easier. Moreover, it has a further advantage of needless of a positioning mechanism in the apparatus, as the positioning can be attained by just installing the developing unit to the drum cartridge even if the developing unit alone is separated.

What is claimed is:

1. A process cartridge exchangeably provided to an image forming apparatus, comprising:

an endless light-sensitive carrier, charging means for charging the light-sensitive carrier, a cleaner for cleaning a residual toner on the light-sensitive carrier, a cartridge frame installed with at least the light-sensitive carrier, the charging means and the cleaner, including a fulcrum hole provided in the cartridge frame, a free fit hole provided in the frame of the developing unit, and a connection rod freely fitted into the fulcrum hole for installing the developing unit to the cartridge frame and wherein the developing unit is a contact type developing unit which develops an electrostatic latent image on the light-sensitive carrier by contacting a developing roller provided on one end of the developing unit for supplying internal developer, with the light-sensitive carrier, and is rotatably movable around the connection rod to the cartridge frame wherein the developing unit is rotatably movable with respect to the cartridge frame;

wherein the fulcrum of the developing unit is provided at a fulcrum position tangent to both the light-sensitive carrier and the developing roller where the developing roller contacts the light-sensitive carrier.

2. The process cartridge according to claim 1, wherein the developing unit further includes pressure applying means for applying pressure to the developing unit around the fulcrum, said pressure applying means and the site where the developing roller contacts the light-sensitive carrier being equidistant from said fulcrum, thereby pressing the developing roller against the light-sensitive carrier.

3. The process cartridge according to claim 2, wherein the pressure applying means includes a pair of coil springs to be provided to opposite sides of the developing unit, and the cartridge frame includes a stopper block along which said pair of coil springs move.

4. The process cartridge according to claim 1, wherein the fulcrum of the developing unit is disposed on a vertical line including the center of gravity of the developing unit.

5. The process cartridge according to claim 1, wherein the developing unit further include a pressure applying means for applying pressure to the developing unit around the fulcrum, said pressure applying means and the site at which the developing roller contacts with the light-sensitive carrier being equidistant from said fulcrum, thereby pressing the developing roller against the light-sensitive carrier.

6. The process cartridge according to claim 5, wherein the pressure applying means includes a pair of coil springs to be provided to opposite sides of the developing unit, and the cartridge frame includes a stopper block along which said pair of coil springs move.

7. The process cartridge according to claim 1, wherein the position of the fulcrum of the developing unit is disposed on a vertical line including the center of gravity of the developing unit.

8. A process cartridge exchangeably provided to an image forming apparatus comprising:

an endless light-sensitive carrier, charging means for charging the light-sensitive carrier, a cleaner for cleaning a residual toner on the light-sensitive carrier, a cartridge frame installed with at least the light-sensitive carrier, the charging means and the cleaner, a developing unit, rotary fulcrum means, the developing unit rotatably provided to the cartridge frame for movement around the rotary fulcrum means for developing an electrostatic latent image in the light-sensitive carrier by contacting the developing roller for supplying internal developer with the light-sensitive carrier, wherein the rotary fulcrum means is positioned in a direction defined by a tangent line to both the light-sensitive carrier and the developing roller where the developing roller contacts the light-sensitive carrier.

9. The process cartridge according to claim 8, wherein the developing unit further includes a pressure applying means for applying pressure to the developing unit around the fulcrum said pressure applying means and the site where the developing roller contacts with the light-sensitive carrier being equidistant from said fulcrum, thereby pressing the developing roller against the light-sensitive carrier.

10. The process cartridge according to claim 9, wherein the pressure applying means includes a pair of coil springs to be provided to opposite sides of the developing unit, and the cartridge frame includes a stopper block along which said pair of coil springs move.

11. The process cartridge according to claim 9, wherein the rotary fulcrum is disposed on a vertical line including the center of gravity of the developing unit.

12. A process cartridge for forming an image exchangeably provided to an image forming apparatus, comprising:

an endless light-sensitive carrier, charging means for charging the light-sensitive carrier, a cleaner for cleaning a residual toner on the light-sensitive carrier, a cartridge frame installed with at least the light-sensitive carrier, the charging means and the cleaner, and a developing unit, rotary fulcrum means, the developing unit rotatably provided to the cartridge frame around the rotary fulcrum means for developing an electrostatic latent image on the light-sensitive carrier by contacting the developing roller for supplying internal developer with the light-sensitive carrier, and wherein the rotary fulcrum means is disposed on a vertical line including the center of gravity of the developing unit.

13. The process cartridge according to claim 12, wherein the developing unit further includes pressure applying means for applying pressure to the developing unit around the rotary fulcrum means, said pressure applying means and the site where the developing roller contacts the light-sensitive carrier being equidistant from said fulcrum, thereby pressing the developing roller against the light-sensitive carrier.

14. The process cartridge according to claim 13, wherein the pressure applying means includes a pair of coil springs provided on opposite sides of the developing unit, and the cartridge frame includes a stopper block along which the pair of coil springs move.

15. The process cartridge according to claim 12, wherein the developing unit is a contact type developing unit which develops an electrostatic latent image on the light-sensitive carrier by contacting a developing roller, provided on one end of the developing unit for supplying internal developer to the light-sensitive carrier, said developing unit being rotatably movable with respect to the cartridge frame.

16. The image forming apparatus according to claim 15, wherein the fulcrum of the developing unit is provided in the direction of a tangent line to both the light-sensitive carrier and the developing roller at a position where the developing roller contacts with the light-sensitive carrier.

17. The process cartridge according to claim 16, wherein the developing unit further includes pressure applying means for applying pressure to the developing unit around the fulcrum, said pressure applying means and the site where the developing roller contacts the light-sensitive carrier being equidistant from said fulcrum, thereby pressing the developing roller against the light sensitive carrier.

18. The image forming apparatus according to claim 17, wherein the pressure applying means includes a pair of coil springs to be provided to the both sides of the developing unit, and the cartridge frame includes a stopper block whereto the pair of coil springs are running.

19. The image forming apparatus according to claim 16, wherein the fulcrum of the developing unit is disposed on a vertical line including the center of gravity of the developing unit.

20. The image forming apparatus according to claim 16 further comprising:

a planet gear provided at the developing unit for driving the developing roller, a driving gear engaging the gear of the developing unit and being provided at a position where a resultant force, consisting of a force of the planet gear pressing against the driving gear and a force in a direction in which the planet gear drives the driving gear is directed to the fulcrum, and driving means for rotating the driving gear.

21. The image forming apparatus according to claim 15, wherein the developing unit further include pressure applying means for applying pressure to the developing unit around the fulcrum in a position symmetrical to the position where the developing roller contacts the light-sensitive carrier, to press the developing roller against the light-sensitive carrier.

22. The image forming apparatus according to claim 21, wherein the developing unit has sides, and wherein the pressure applying means includes a pair of coil springs provided at both sides of the developing unit, and the cartridge frame includes a stopper block along which the pair of coil springs move.

23. The image forming apparatus according to claim 15 further comprising:

a planet gear provided at the developing unit for driving the developing roller, a driving gear engaging the planet gear of the developing unit and being provided at a position where a resultant force, consisting of a force of the planet gear pressing against the driving gear and a force in a direction in which the planet gear drives the driving gear, is directed to the fulcrum, and driving means for rotating the driving gear.

24. An image forming apparatus for forming an image onto a sheet comprising:

an endless light-sensitive carrier, charging means for charging the light-sensitive carrier, optical means for exposing the charged light-sensitive carrier to a light image, a cleaner for cleaning residual toner on the light-sensitive carrier, a process cartridge installed with at least the light-sensitive carrier, the charging means and the cleaner, and being detachable from the apparatus, a developing unit, rotary fulcrum means, the developing unit being rotatably provided to the cartridge frame around the rotary fulcrum means, developing an electrostatic latent image on the light-sensitive carrier by contacting a developing roller for feeding internal developer with the light-sensitive carrier, transfer means for transferring a toner image on the light-sensitive carrier onto a sheet; and wherein the rotary fulcrum means is positioned in the direction of a tangent line to both the light-sensitive carrier and the developing roller where the developing roller contacts the light-sensitive carrier.

25. The image forming apparatus according to claim 24, wherein the developing unit includes pressure applying means for applying pressure to the developing unit around the rotary fulcrum means, said pressure applying means and the site where the developing roller contacts the light-sensitive carrier being equidistant from said fulcrum, thereby pressing the developing roller against the light-sensitive carrier.

26. The image forming apparatus according to claim 25, wherein the pressure applying means includes a pair of coil springs provided on opposite sides of the developing unit, and wherein the cartridge frame includes a stopper block along which the pair of coil springs move.

27. The image forming apparatus according to claim 24, wherein the rotary fulcrum means is disposed on a vertical line including the center of gravity of the developing unit.

28. The image forming apparatus according to claim 27 further comprising:

a planet gear for driving the developing roller, a driving gear engaging with the planet gear of the developing unit, and being provided at a position where a resultant force, consisting of a force of the planet gear pressing against the driving gear and a force in a direction in which the planet gear drives the driving gear, is directed to the fulcrum, and driving means for rotating the driving gear.

29. The image forming apparatus according to claim 24 further comprising:

a planet gear for driving the developing roller, a driving gear engaging with the planet gear of the developing unit, and being provided at a position where a resultant force, consisting of a force of the planet gear pressing against the driving gear and a force in a direction in which the planet gear drives the driving gear, is directed to the fulcrum, and driving means for rotating the driving gear.

30. An image forming apparatus for forming an image on a sheet comprising:

an endless light-sensitive carrier, charging means for charging the light-sensitive carrier, optical means for exposing the charged light-sensitive carrier to a light image, a cleaner for cleaning a residual toner on the light-sensitive carrier, a process cartridge installed with at least the light-sensitive carrier, the charging means and the cleaner, and being detachable from the apparatus, a developing unit, a rotary fulcrum, the developing unit rotatably provided to the cartridge frame around the rotary fulcrum, developing an electrostatic latent image on the light-sensitive carrier by contacting a developing roller for supplying internal developer with the light-sensitive carrier, transfer means for transferring a toner image on the light-sensitive carrier onto a sheet; and wherein the rotary fulcrum is disposed on a vertical line including the center of gravity of the developing unit.

31. The image forming apparatus according to claim 30, wherein the developing unit further includes pressure applying means for applying pressure to the developing unit around the rotary fulcrum said pressure applying means and the site where the developing roller contacts the light-sensitive carrier being equidistant from said fulcrum, thereby pressing the developing roller against the light-sensitive carrier.

32. The image forming apparatus according to claim 31, wherein the pressure applying means includes a pair of coil springs provided at both sides of the developing unit, and the cartridge frame includes a stopper block whereto the pair of coil springs are running.

33. The image forming apparatus according to claim 30 further comprising:

a planet gear for driving the developing roller, a driving gear engaging with the planet gear of the developing unit, and being provided at a position where a resultant force, consisting of a force of the planet gear pressing against the driving gear and a force in a direction in which the planet gear drives the driving gear, is directed to the fulcrum, and driving means for rotating the driving gear.

34. An image forming apparatus for forming an image on a sheet comprising:

an endless light-sensitive carrier, charging means for charging the light-sensitive carrier, optical means for exposing the charged light-sensitive carrier to a light image, a cleaner for cleaning a residual toner on the light-sensitive carrier, a process cartridge installed with at least the light-sensitive carrier, the charging means and the cleaner, and being detachable from the apparatus, a developing unit, a rotary fulcrum, the developing unit being rotatably mounted to the cartridge frame about the rotary fulcrum, developing an electrostatic latent image on the light-sensitive carrier by contacting a developing roller for feeding internal developer with the light-sensitive carrier, a planet gear for driving the developing roller, a driving gear engaging with the planet gear of the developing unit, and being provided at a position where a resultant force, consisting of a force of the planet gear pressing against the driving gear and a force in a direction in which the planet gear drives the driving gear, is directed to the fulcrum, and driving means for rotating the driving gear.

35. A process cartridge exchangeably provided to an image forming apparatus, comprising:

an endless light-sensitive carrier;

charging means for charging the light-sensitive carrier;

a cleaner for cleaning residual toner on the light-sensitive carrier;

a cartridge frame installed with at least the light-sensitive carrier, the charging means and said cleaner, the cartridge frame having a fulcrum hole;

a developing unit detachably provided to the cartridge frame for developing an electrostatic image on the light-sensitive carrier, the developing unit including a developing unit frame having a free fit hole; and a single connection rod freely fitted into the fulcrum hole of the cartridge frame, and freely fitted to the free fit hole of the developing unit frame for installing the developing unit to the cartridge frame such that the developing unit is rotatably movable with respect to the cartridge frame, said single connection rod being detachable from the fulcrum hole and the free fit hole so that said developing unit is detachable from said cartridge frame, said single connection rod having a blocker for locking said single connection rod to said cartridge frame.

36. A process cartridge exchangeably provided to an image forming apparatus, comprising:

an endless light-sensitive carrier;

charging means for charging the light-sensitive carrier;

a cleaner for cleaning residual toner on the light-sensitive carrier;

a cartridge frame installed with at least the light-sensitive carrier, the charging means and said cleaner, the cartridge frame having a fulcrum hole;

a developing unit detachably provided to the cartridge frame for developing an electrostatic image on the light-sensitive carrier, the developing unit including a developing unit frame having a free fit hole;

a single connection rod freely fitted into the fulcrum hole of the cartridge frame, and freely fitted to the free fit hole of the developing unit frame for installing the developing unit to the cartridge frame such that the developing unit is rotatably movable with respect to the cartridge frame; and wherein the fulcrum of the developing unit is positioned along the direction of a tangent line to both the light-sensitive carrier and the developing roller where the developing roller contacts the light-sensitive carrier.

37. The process cartridge according to claim 36, wherein the developing unit further includes pressure applying means for applying pressure to the developing unit around the fulcrum, said pressure applying means and the site where the developing roller contacts the light-sensitive carrier being equidistant from said fulcrum, thereby pressing the developing roller against the light sensitive carrier.

38. The process cartridge according to claim 36, wherein the developing unit further includes pressure applying means for applying pressure to the developing unit around the fulcrum in a direction symmetrical to a position where the developing roller contacts the light-sensitive carrier thereby pressing the developing roller against the light sensitive carrier.

39. A process cartridge exchangeably provided to an image forming apparatus as in claim 36, wherein the fulcrum of the developing unit is disposed on a vertical line including the center of gravity of the developing unit.

40. A process cartridge exchangeably provided to an image forming, comprising an endless light-sensitive carrier;

charging means for charging the light-sensitive carrier;

a cleaner for cleaning residual toner on the light-sensitive carrier;

a cartridge frame installed with at least the light-sensitive carrier, the charging means and said cleaner, the cartridge frame having a fulcrum hole;

a developing unit detachably provided to the cartridge frame for developing an electrostatic image on the light-sensitive carrier, the developing unit including a developing unit frame having a free fit hole; and a single connection rod freely fitted into the fulcrum hole of the cartridge frame, and freely fitted to the free fit hole of the developing unit frame for installing the developing unit to the cartridge frame such that the developing unit is rotatably movable with respect to the cartridge frame;

wherein the fulcrum of the developing unit is disposed on a vertical line including the center of gravity of the developing unit.

41. A process cartridge exchangeably provided to an image forming apparatus as in claim 37, wherein the pressure applying means includes a pair of coil springs at the sides of the developing unit, and wherein the cartridge frame includes a stopper block along which the coil springs move.

42. An image forming apparatus for forming an image onto a sheet comprising:

an endless light-sensitive carrier;

charging means for charging the light-sensitive carrier;

optical means for exposing the light-sensitive carrier charged by the charging means;

a cleaner for cleaning a residual toner on the light-sensitive carrier;

a process cartridge installed with at least the light-sensitive carrier, the charging means and the cleaner, the cartridge being detachable from the image forming apparatus and having a fulcrum hole;

a developing unit, detachably provided to the process cartridge, for developing an electrostatic image on the light-sensitive carrier, the developing unit including a developing unit frame having a free fit hole; and transfer means for transferring a toner image on the light-sensitive carrier onto a sheet; and a connection rod freely fitted into the fulcrum hole of the process cartridge, and further freely fitted to the free fit hole of the developing unit frame for installing the developing unit to the cartridge frame such that the developing unit is rotatably movable with respect to the cartridge frame, said connection rod being detachable from the fulcrum hole and the free fit hole so that said developing unit is detachable from said cartridge frame, said connection rod having a blocker for locking said single connection rod to said cartridge frame.

43. An image forming apparatus for forming an image onto a sheet according to claim 42, wherein the developing unit is a contact type developing unit which develops a electrostatic latent image on the light-sensitive carrier by contacting a developing roller provided on one end of the developing unit for supplying internal developer to the light-sensitive carrier, the developing unit being rotatably movable with respect to the cartridge around the connection rod.

44. An image forming apparatus for forming an image onto a sheet according to claim 43, further comprising:

a planet gear provided to the developing unit for driving the developing roller, a driving gear engaging the planet gear of the developing unit and being located where a resultant force, consisting of a force of the planet gear pressing against the driving gear and a force in a direction in which the planet gear drives the driving gear, is directed to the fulcrum, and driving means for rotating the driving gear.

45. An image forming apparatus for forming an image onto a sheet, comprising;

an endless light-sensitive carrier;

charging means for charging the light-sensitive carrier;

optical means for exposing the light-sensitive carrier charged by the charging means;

a cleaner for cleaning a residual toner on the light-sensitive carrier;

a process cartridge installed with at least the light-sensitive carrier, the charging means and the cleaner, the cartridge being detachable from the image forming apparatus and having a fulcrum hole;

a developing unit, detachably provided to the process cartridge, for developing an electrostatic image on the light-sensitive carrier, the developing unit including a developing unit frame having a free fit hole;

transfer means for transferring a toner image on the light-sensitive carrier onto a sheet; and a connection rod freely fitted into the fulcrum hole of the process cartridge, and further freely fitted to the free fit hole of the developing unit frame for installing the developing unit to the cartridge frame such that the developing unit is rotatably movable with respect to the cartridge frame;

wherein the fulcrum of the developing unit is provided in the direction of a tangent line to both the light-sensitive carrier and the developing roller where the developing roller contacts the light-sensitive carrier.

46. An image forming apparatus for forming an image onto a sheet according to claim 45, wherein the developing unit has sides, wherein the pressure applying means includes a pair of coil springs provided at both sides of the developing unit, and wherein the cartridge frame includes a stopper block along which the pair of coil springs move.

47. An image forming apparatus for forming an image onto a sheet according to claim 45, further comprising a planet gear provided to the developing unit for driving the developing roller, a driving gear engaging the planet gear of the developing unit and being located where a resultant force, consisting of a force of the planet gear pressing against the drive gear and a force in a direction in which the planet gear drives the drive gear, is directed to the fulcrum, and driving means for rotating the driving gear.

48. Am image forming apparatus for forming an image onto a sheet according to claim 47, wherein the pressure applying means includes a pair of coil springs provided at the sides of the developing unit, and wherein the cartridge includes a stopper block against which the pair of coil springs move.

49. An image forming apparatus for forming an image onto a sheet according to claim 45, wherein the developing unit further includes pressure applying means for applying pressure to the developing unit around the fulcrum in a direction symmetrical to where the developing roller contacts the light-sensitive carrier, to press the developing roller against the light-sensitive carrier.

50. An image forming apparatus for forming an image onto a sheet according to claim 45, wherein the fulcrum of the developing unit is disposed on a vertical line including the center of gravity of the developing unit.

51. An image forming apparatus for forming an image onto a sheet, comprising;

an endless light-sensitive carrier;

charging means for charging the light-sensitive carrier;

optical means for exposing the light-sensitive carrier charged by the charging means;

a cleaner for cleaning a residual toner on the light-sensitive carrier;

a process cartridge installed with at least the light-sensitive carrier, the charging means and the cleaner, the cartridge being detachable from the image forming apparatus and having a fulcrum hole;

a developing unit, detachably provided to the process cartridge, for developing an electrostatic image on the light-sensitive carrier, the developing unit including a developing unit frame having a free fit hole;

transfer means for transferring a toner image on the light-sensitive carrier onto a sheet; and a connection rod freely fitted into the fulcrum hole of the process cartridge, and further freely fitted to the free fit hole of the developing unit frame for installing the developing unit to the cartridge frame such that the developing unit is rotatably movable with respect to the cartridge frame;

wherein the developing unit further includes pressure applying means for applying pressure to the developing unit around the fulcrum in a position symmetrical to where the developing roller contacts the light-sensitive carrier, to press the developing roller against the light-sensitive carrier.

52. An image forming apparatus for forming an image onto a sheet comprising an endless light-sensitive carrier;

charging means for charging the light-sensitive carrier;

optical means for exposing the light-sensitive carrier charged by the charging means;

a cleaner for cleaning a residual toner on the light-sensitive carrier;

a process cartridge installed with at least the light-sensitive carrier, the charging means and the cleaner, the cartridge being detachable from the image forming apparatus and having a fulcrum hole;

a developing unit, detachably provided to the process cartridge, for developing an electrostatic image on the light-sensitive carrier, the developing unit including a developing unit frame having a free fit hole; and transfer means for transferring a toner image on the light-sensitive carrier onto a sheet; and a connection rod freely fitted into the fulcrum hole of the process cartridge, and further freely fitted to the free fit hole of the developing unit frame for installing the developing unit to the cartridge frame such that the developing unit is rotatably movable with respect to the cartridge frame;

wherein the fulcrum of the developing unit is disposed on a vertical line including the center of gravity of the developing unit.

* * * * *